US011491606B2

(12) United States Patent
Liu

(10) Patent No.: US 11,491,606 B2
(45) Date of Patent: Nov. 8, 2022

(54) GRINDING MODULE, A GRINDING MACHINE AND A METHOD FOR GRINDING

(71) Applicant: ST ENGINEERING AEROSPACE LTD., Singapore (SG)

(72) Inventor: Yong Wee Liu, Singapore (SG)

(73) Assignee: ST ENGINEERING AEROSPACE LTD., Paya Lebar (SG)

( * ) Notice: Subject to any disclaimer, the term of this patent is extended or adjusted under 35 U.S.C. 154(b) by 922 days.

(21) Appl. No.: 15/770,151

(22) PCT Filed: Oct. 21, 2015

(86) PCT No.: PCT/SG2015/050402
§ 371 (c)(1),
(2) Date: Apr. 20, 2018

(87) PCT Pub. No.: WO2017/069696
PCT Pub. Date: Apr. 27, 2017

(65) Prior Publication Data

US 2018/0311785 A1 Nov. 1, 2018

(51) Int. Cl.
*B24B 41/06* (2012.01)
*B24B 41/02* (2006.01)
(Continued)

(52) U.S. Cl.
CPC ..... *B24B 41/06* (2013.01); *B24B 19/009* (2013.01); *B24B 21/16* (2013.01); *B24B 41/02* (2013.01); *B24B 47/12* (2013.01)

(58) Field of Classification Search
CPC ..... B24B 41/06; B24B 41/02; B24B 19/009; B24B 19/26; B24B 21/16; B24B 21/18;
(Continued)

(56) References Cited

U.S. PATENT DOCUMENTS 1,589,043 A * 6/1926 Binns ..... B24B 45/00 451/365
2,087,662 A * 7/1937 Bysshe ..... B24B 49/18 125/11.16

(Continued)

FOREIGN PATENT DOCUMENTS

CN 203887664 U 10/2014
TW 201338920 10/2013

OTHER PUBLICATIONS

Taiwanese Office Action dated Jun. 21, 2018 regarding Taiwanese Patent Application No. 15770151 corresponding to U.S. Appl. No. 15/770,151 (14 pages) with English Translation (11 pages).

*Primary Examiner* — Orlando E Aviles
*Assistant Examiner* — Marcel T Dion
(74) *Attorney, Agent, or Firm* — Lewis Roca Rothgerber Christie LLP

(57) ABSTRACT

According to various embodiments, there is provided a grinding module including a base; a cylinder mounted to the base with a longitudinal axis of the cylinder arranged at least substantially perpendicular to a surface of the base, wherein the cylinder is rotatable about the longitudinal axis of the cylinder, and wherein a cylindrical surface of the cylinder is adapted to receive a grinding belt; a linear actuator mounted to the base with a centreline of linear motion of the linear actuator arranged to intersect the longitudinal axis of the cylinder; and a holder connected to the linear actuator, the holder adapted to hold a workpiece with a surface of the workpiece facing the cylindrical surface of the cylinder, wherein the linear actuator is adapted to move the holder relative to the cylinder along the centreline of linear motion of the linear actuator, and wherein the cylindrical surface of the cylinder is adapted to define a curved profile so that the
(Continued)

grinding belt is adapted to grind and shape the surface of the workpiece to conform to the curved profile.

20 Claims, 14 Drawing Sheets

(51) Int. Cl.
*B24B 21/16* (2006.01)
*B24B 19/00* (2006.01)
*B24B 47/12* (2006.01)

(58) Field of Classification Search
CPC ..... B24B 21/20; B24B 47/12; B24D 9/02; B24D 9/04
USPC ... 451/28, 296, 303, 311, 12, 299, 301, 331, 451/349, 361, 513, 406–410
See application file for complete search history.

(56) References Cited

U.S. PATENT DOCUMENTS 2,723,506 A * 11/1955 Paynton, Sr. ..... B24B 21/02 451/406
2,751,723 A 6/1956 Lindmark
2,898,713 A * 8/1959 Jansson ..... B24B 41/06 33/577
3,209,496 A * 10/1965 Robischung ..... B24B 21/00 451/297
3,651,605 A * 3/1972 Tittle ..... B24B 49/00 451/142
3,789,551 A * 2/1974 Norris ..... B24B 3/003 451/28
3,896,592 A 7/1975 Wintz
3,902,282 A * 9/1975 Roscoe ..... G10D 9/035 451/226
4,104,833 A * 8/1978 Glowacki ..... B24B 49/18 451/21
4,574,531 A * 3/1986 McCurry ..... B24B 23/06 451/297
4,720,939 A * 1/1988 Simpson ..... B24B 53/10 451/5
4,760,672 A * 8/1988 Darcangelo ..... B24B 13/043 451/232
5,357,714 A 10/1994 Landhuis
5,871,390 A * 2/1999 Pant ..... B24B 37/04 451/5
6,155,917 A * 12/2000 Tasikas ..... B24B 7/188 451/350
8,784,162 B1 * 7/2014 Dovel ..... B24D 15/06 451/303
2002/0009959 A1 * 1/2002 Talieh ..... B24B 21/22 451/296
2006/0111027 A1 * 5/2006 Laney ..... B24B 3/52 451/293
2007/0238401 A1 * 10/2007 Wall ..... B24B 21/20 451/355
2008/0182482 A1 * 7/2008 Nomura ..... B24B 9/065 451/296
2008/0311824 A1 * 12/2008 Sarani ..... B24B 55/08 451/11
2012/0052777 A1 * 3/2012 Chang ..... B24B 21/10 451/355
2017/0278488 A1 * 9/2017 Roadman ..... G10D 1/08

* cited by examiner

GRINDING MODULE, A GRINDING MACHINE AND A METHOD FOR GRINDING

CROSS-REFERENCE TO RELATED APPLICATION(S)

This application is a National Phase Patent Application and claims the priority of International Application Number PCT/SG2015/050402, filed on Oct. 21, 2015, the entire contents of which are incorporated herein by reference.

TECHNICAL FIELD

Embodiments relate generally to a grinding module, a grinding machine and a method for grinding.

BACKGROUND

Casting process is a common manufacturing process. Parts manufactured from the casting process would usually include excess solidified materials that require post-processing to remove such excess solidified materials. The excess solidified materials on the parts manufactured from the casting process differ between each manufactured part. This inherent variability of the excess solidified materials on the manufactured parts poses a challenge for post-processing to remove the excess solidified materials.

Typically, the post-processing processes include manual grinding process or computer numerical control (CNC) milling/turning process. In manual grinding process, a skilled operator is required to perform the grinding by manually feeding a manufactured part to a grinding machine, and constantly adjusting the orientation of the manufactured part depending on the location and the amount of the excess solidified material to be grinded. In other words, the compensation for the inherent variability of the excess solidified material during grinding is dependent on the skilled operator. Accordingly, the rate of completion of a finished grinded product from a manual grinding process is dependent on the knowledge and the skills of the operator, as well as the complexity of the variable excess solidified materials on the original manufactured part. In CNC milling/turning process, a longer setup process and a higher setup cost are usually expected. This is because custom designed and fabricated fixtures are usually required to adapt the CNC milling/turning machine for post-processing of the specific manufactured parts. A skilled machinist may be required to design and fabricate the fixtures. Further, the cutter of the CNC milling/turning machine may typically require frequent replacement which may translate to a higher cost of production.

Therefore, there is a need to address some of the issues discussed above in relation to the existing post-processing processes of parts manufactured from casting.

SUMMARY

According to various embodiments, there is provided a grinding module including a base; a cylinder mounted to the base with a longitudinal axis of the cylinder arranged at least substantially perpendicular to a surface of the base, wherein the cylinder is rotatable about the longitudinal axis of the cylinder, and wherein a cylindrical surface of the cylinder is adapted to receive a grinding belt; a linear actuator mounted to the base with a centreline of linear motion of the linear actuator arranged to intersect the longitudinal axis of the cylinder; and a holder connected to the linear actuator, the holder adapted to hold a workpiece with a surface of the workpiece facing the cylindrical surface of the cylinder, wherein the linear actuator is adapted to move the holder relative to the cylinder along the centreline of linear motion of the linear actuator, and wherein the cylindrical surface of the cylinder is adapted to define a curved profile so that the grinding belt is adapted to grind and shape the surface of the workpiece to conform to the curved profile.

According to various embodiments, there is provided a grinding machine including a grinding module as described herein; a motor module connected to the grinding module, the motor module comprising a motor operable to drive the grinding belt received on the cylindrical surface of the cylinder of the grinding module; and a support frame module connected to the motor module, the support frame module adapted to support the motor module and the grinding module.

According to various embodiments, there is provided a method for grinding including mounting a workpiece to a holder, the holder connected to a linear actuator, the holder adapted to hold the workpiece with a surface of the workpiece facing a cylindrical surface of a cylinder; and operating a linear actuator to move the holder relative to the cylinder along a centreline of linear motion of the linear actuator, wherein the cylinder is mounted to a base with a longitudinal axis of the cylinder arranged at least substantially perpendicular to a surface of the base, wherein the cylinder is rotatable about the longitudinal axis of the cylinder, and wherein a cylindrical surface of the cylinder is adapted to receive a grinding belt, and wherein the linear actuator is mounted to the base with the centreline of linear motion of the linear actuator arranged to intersect the longitudinal axis of the cylinder, and wherein the cylindrical surface of the cylinder is adapted to define a curved profile so that the grinding belt is adapted to grind and shape the surface of the workpiece to conform to the curved profile.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described with reference to the following drawings, in which.

DETAILED DESCRIPTION

Embodiments described below in context of the apparatus are analogously valid for the respective methods, and vice versa. Furthermore, it will be understood that the embodiments described below may be combined, for example, a part of one embodiment may be combined with a part of another embodiment.

It should be understood that the terms "on", "over", "top", "bottom", "down", "side", "back", "left", "right", "front", "lateral", "side", "up", "down" etc., when used in the following description are used for convenience and to aid understanding of relative positions or directions, and not intended to limit the orientation of any device, or structure or any part of any device or structure.

Figure 1A:
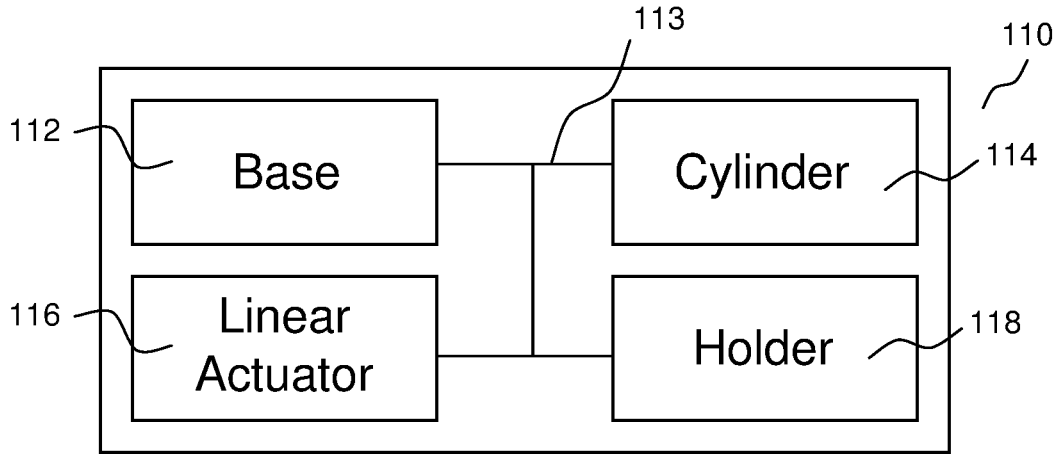
FIG. 1A shows a grinding module according to various embodiments.

FIG. 1A shows a grinding module 110 according to various embodiments. The grinding module 110 may include a base 112. The grinding module 110 may further include a cylinder 114 mounted to the base 112 with a longitudinal axis of the cylinder 114 arranged at least substantially perpendicular to a surface of the base 112. The cylinder 114 may be rotatable about the longitudinal axis of the cylinder 114. A cylindrical surface of the cylinder 114 may be adapted to receive a grinding belt. The grinding module 110 may further include a linear actuator 116 mounted to the base 112 with a centreline of linear motion of the linear actuator 116 arranged to intersect the longitudinal axis of the cylinder 114. The grinding module 110 may further include a holder 118 connected to the linear actuator 116. The holder 118 may be adapted to hold a workpiece with a surface of the workpiece facing the cylindrical surface of the cylinder 114. The linear actuator 116 may be adapted to move the holder 118 relative to the cylinder 114 along the centreline of linear motion of the linear actuator 116. The cylindrical surface of the cylinder 114 may be adapted to define a curved profile so that the grinding belt is adapted to grind and shape the surface of the workpiece to conform to the curved profile. The base 112, the cylinder 114, the linear actuator 116 and the holder 118 may be connected with each other directly or indirectly, like indicated by lines 113.

In other words, the grinding module 110 may include a support platform on which the components of the grinding module 110 may be mounted on. The grinding module 110 may further include a cylindrical drum with an end of the cylindrical drum mounted to a surface of the support platform so that a longitudinal axis of the cylindrical drum may be at least substantially perpendicular to the surface of the support platform. The cylindrical drum may be rotatably mounted to the base so that the cylindrical drum may be rotatable about the longitudinal axis of the cylindrical drum. The cylindrical drum may be configured such that a belt lined with abrasive may be received on a cylindrical surface of the cylindrical drum. The grinding module 110 may further include a feeding mechanism that is adapted to feed a workpiece in a straight line towards the cylindrical surface of the cylindrical drum. The feeding mechanism may be arranged such that the straight line of motion of the feeding mechanism intersects with the longitudinal axis of the cylindrical drum. The feeding mechanism may include a driving mechanism that generates motion in a straight line, and an attachment member connected to the driving mechanism. The attachment member may be adapted to receive the workpiece in an orientation whereby a surface of the workpiece faces the cylindrical surface of the cylindrical drum. The driving mechanism may be adapted to move the attachment member so that the workpiece may be fed toward the cylindrical surface in a straight line motion. The belt lined with abrasive may adopt the shape and curvature of the cylindrical surface of the cylindrical drum because the belt is received on the cylindrical surface. When the belt is being driven or set into motion, the surface of the workpiece which is brought into contact with the moving belt by the feeding mechanism may be abraded or grinded to adopt the shape and curvature of the cylindrical surface of the cylindrical drum.

Figure 1B:
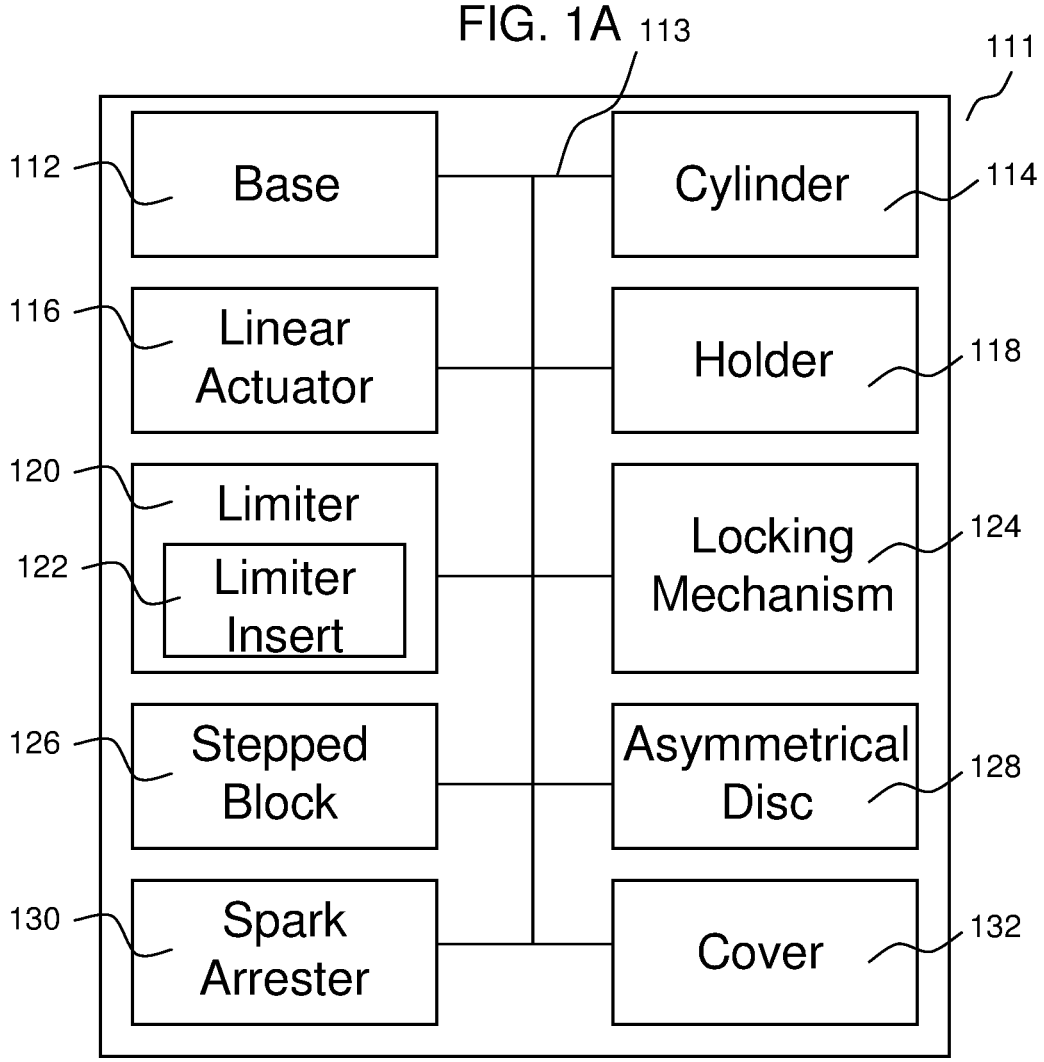
FIG. 1B shows a grinding module according to various embodiments.

FIG. 1B shows a grinding module 111 according to various embodiments. The grinding module 111 may, similar to the grinding module 110 of FIG. 1A, include a base 112. The grinding module 111 may, similar to the grinding module 110 of FIG. 1A, further include a cylinder 114 mounted to the base 112 with a longitudinal axis of the cylinder 114 arranged at least substantially perpendicular to a surface of the base 112. The cylinder 114 may be rotatable about the longitudinal axis of the cylinder 114. The cylindrical surface of the cylinder 114 may be adapted to receive a grinding belt. The grinding module 111 may, similar to the grinding module 110 of FIG. 1A, further include a linear actuator 116 mounted to the base 112 with a centreline of linear motion of the linear actuator 116 arranged to intersect the longitudinal axis of the cylinder 114. The grinding module 111 may, similar to the grinding module 110 of FIG. 1A, further include a holder 118 connected to the linear actuator 116. The holder 118 may be adapted to hold a workpiece with a surface of the workpiece facing the cylindrical surface of the cylinder 114. The linear actuator 116 may be adapted to move the holder 118 relative to the cylinder 114 along the centreline of linear motion of the linear actuator 116. The cylindrical surface of the cylinder 114 may be adapted to define a curved profile so that the grinding belt is adapted to grind and shape the surface of the workpiece to conform to the curved profile. Lines 113 represent the direct/indirect connections between the respective components of the grinding module 111.

According to various embodiments, the centreline of linear motion of the linear actuator 116 may be arranged at least substantially perpendicular to the longitudinal axis of the cylinder 114.

According to various embodiments, the cylinder 114 may be made of metal.

According to various embodiments, the cylindrical surface of the cylinder 114 may be adapted to directly receive the grinding belt.

According to various embodiments, the workpiece may include a concave cylindrical surface.

According to various embodiments, the surface of the workpiece facing the cylindrical surface of the cylinder may be the concave cylindrical surface. The holder 118 may be adapted to orientate the concave cylindrical surface of the workpiece so that a longitudinal axis of the concave cylindrical surface is parallel to the longitudinal axis of the cylinder 114 and the longitudinal axis of the concave cylindrical surface intersects the centreline of linear motion of the linear actuator 116.

According to various embodiments, the grinding module 111 may further include a limiter 120 mounted to the base 112 and arranged between the cylinder 114 and the holder 118. The limiter 120 may be adapted to block the holder 118 at a predetermined distance from the cylindrical surface of the cylinder 114.

According to various embodiments, the limiter 120 may include a limiter insert 122 removably receivable in the limiter 120. The limiter insert 122 received in the limiter 120 may be adapted to provide a protrusion on a surface of the limiter 120 facing the holder 118 to increase the predetermined distance at which the limiter 120 blocks the holder 118.

According to various embodiments, the grinding module 111 may further include a locking mechanism 124 adapted to secure the workpiece to the holder 118 in a retracted position relative to the linear actuator 116.

According to various embodiments, the grinding module 111 may further include a stepped block 126 connected to the base 112, the stepped block 126 may be adapted to receive the linear actuator 116 on each step of the stepped block 126 to vary a height of the linear actuator 116 from the base 112.

According to various embodiments, the grinding module 111 may further include an asymmetrical disc 128 connected to an end of the cylinder 114 opposite the base 112. The asymmetrical disc 128 may include a first arc sector adapted to flush with the cylindrical surface of the cylinder 114 and a second arc sector adapted to protrude from the cylindrical surface of the cylinder 114.

According to various embodiments, the grinding module 111 may further include a spark arrester 130 mounted on the base 112. The spark arrester 130 may be arranged adjacent to the cylindrical surface of the cylinder 114.

According to various embodiments, the grinding module 111 may further include a cover 132 over the linear actuator 116.

Figure 1C:
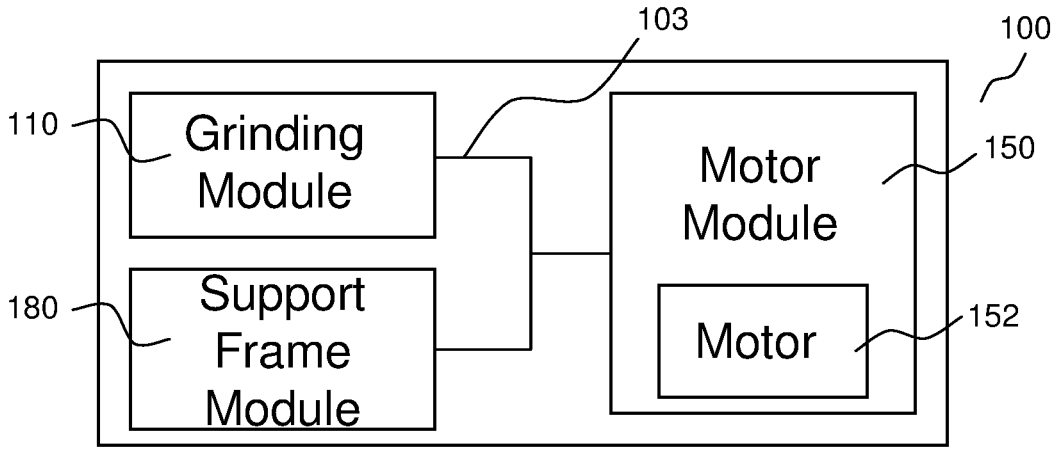
FIG. 1C shows a grinding machine according to various embodiments.

FIG. 1C shows a grinding machine 100 according to various embodiments. The grinding machine 100 may include a grinding module 110, 111 as described above. The grinding machine 100 may further include a motor module 150 connected to the grinding module 110, 111. The motor module 150 may include a motor 152 operable to drive the grinding belt received on the cylindrical surface of the cylinder 114 of the grinding module 110, 111. The grinding machine 100 may further include a support frame module 180 connected to the motor module 150. The support frame module 180 may be adapted to support the motor module 150 and the grinding module 110, 111. The grinding module 110, 111, the motor module 150, and the support frame module 180 may be connected with each other directly or indirectly, like indicated by lines 103.

In other words, the grinding machine 100 may include three subassemblies. The grinding machine 100 may include a grinding subassembly similar to the grinding module 110, 111. The grinding subassembly may include features to receive a workpiece, and feed the workpiece towards a grinding belt to grind the workpiece into a desired dimension in one action. The grinding machine 100 may further include a motor subassembly which includes a driving mechanism to drive the grinding belt going through the grinding subassembly. The grinding machine 100 may further include a support subassembly which include the supporting framework for providing support to the motor subassembly and the grinding subassembly.

Figure 1D:
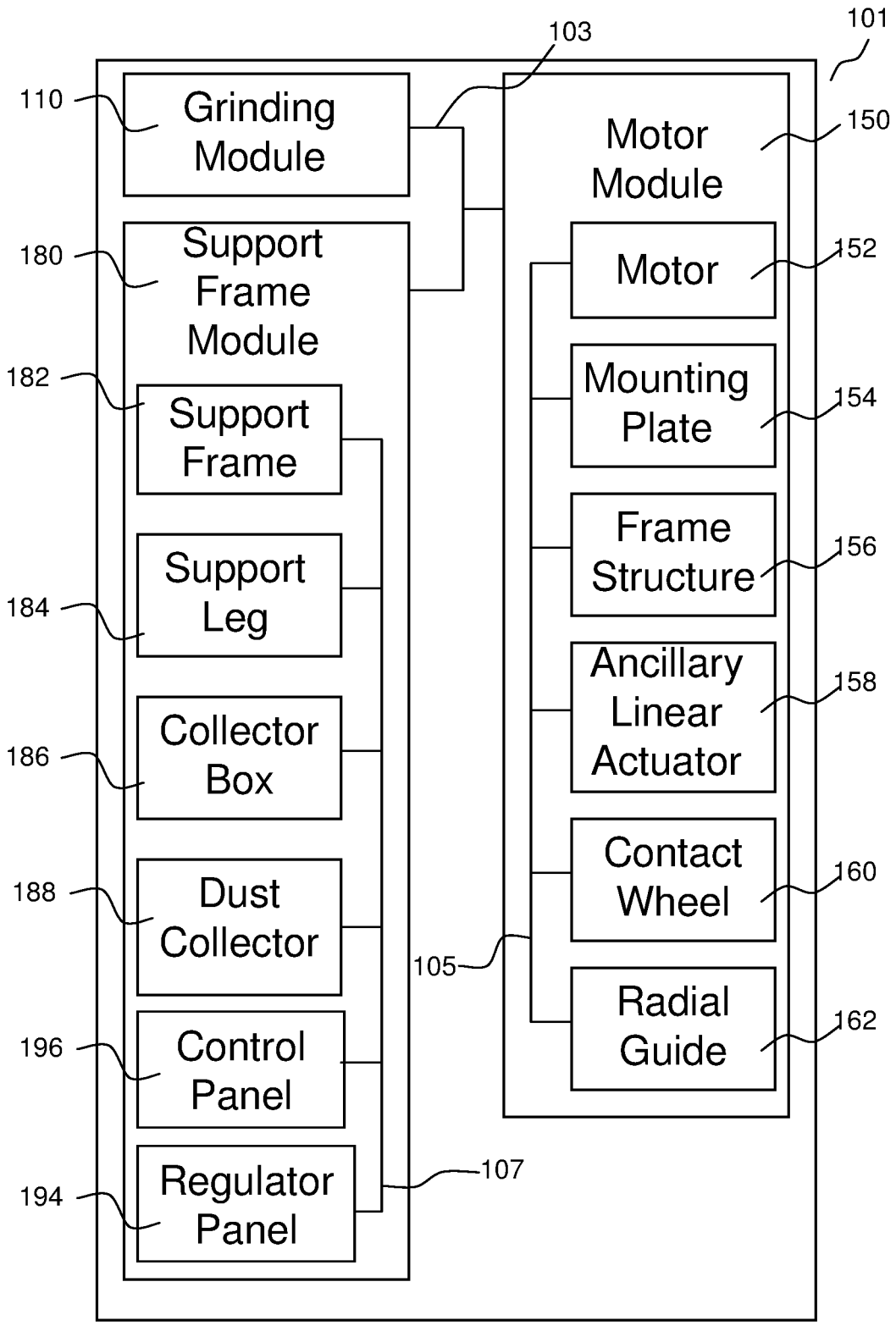
FIG. 1D shows a grinding machine according to various embodiments.

FIG. 1D shows a grinding machine 101 according to various embodiments. The grinding machine 101 may, similar to the grinding machine 100 of FIG. 1C, include a grinding module 110, 111 as described above. The grinding machine 101 may, similar to the grinding machine 100 of FIG. 1C, further include a motor module 150 connected to the grinding module 110, 111. The motor module 150 may include a motor 152 operable to drive the grinding belt received on the cylindrical surface of the cylinder 114 of the grinding module 110, 111. The grinding machine 100 may, similar to the grinding machine 100 of FIG. 1C, further include a support frame module 180 connected to the motor module 150. The support frame module 180 may be adapted to support the motor module 150 and the grinding module 110, 111. The grinding module 110, 111, the motor module 150, and the support frame module 180 may be connected with each other directly or indirectly, like indicated by lines 103. Lines 105 represent the direct/indirect connections between the respective components of the motor module 150. Lines 107 represent the direct/indirect connections between the respective components of the support frame module 180.

According to various embodiments, the motor module 150 may further include a frame structure 156 and a mounting plate 154 slidably received on the frame structure 156. The motor 152 may be connected to the mounting plate 154.

According to various embodiments, the motor module 150 may further include an ancillary linear actuator 158 connecting the mounting plate 154 to the frame structure 156. The ancillary linear actuator 158 may be adapted to move the mounting plate 154 relative to the frame structure 156.

According to various embodiments, the motor module 150 may include a contact wheel 160 connected to the motor 152. The contact wheel 160 may be adapted to receive the grinding belt and to drive the grinding belt.

According to various embodiments, the motor module 150 may further include a radial guide 162 connected to the contact wheel 160. The radial guide 162 may be adapted to maintain the grinding belt on the contact wheel 160.

According to various embodiments, the grinding module 110, 111 and the motor module 150 may be connected to each other via a pivot joint and a leveling mechanism.

According to various embodiments, the leveling mechanism may include a bracket connected to the frame structure of the motor module. The leveling mechanism may further include a bolt with a first end of the bolt connected to an arm of the bracket. The leveling mechanism may further include a guide assembly connected to the base of the grinding module. The guide assembly may be slidably received on the bolt. The leveling mechanism may further include a spring arranged on the bolt between the arm of the bracket and the guide assembly. The leveling mechanism may further include a knob connected to a second end of the bolt.

According to various embodiments, the leveling mechanism may include a bracket connected to the frame structure of the motor module. The leveling mechanism may further include a bolt with a first end of the bolt connected to an arm of the bracket. The leveling mechanism may further include a guide assembly connected to the base of the grinding module. The guide assembly may be slidably received on the bolt. The leveling mechanism may further include a nut connected to a second end of the bolt. The leveling mechanism may further include a first spring arranged on the bolt between the arm of the bracket and the guide assembly. The leveling mechanism may further include a second spring arranged on the bolt between the guide assembly and the nut.

According to various embodiments, the support frame module 180 may include a support frame 182. The support frame module 180 may further include a support leg 184 connected to the support frame 182.

According to various embodiments, the base 112 of the grinding module 110, 111 may include an opening.

According to various embodiments, the support frame module 180 may further include a collector box 186 connected to the support frame 182. A cavity defined by the collector box 186 may be arranged to face the opening of the base 112 of the grinding module 110, 111.

According to various embodiments, the support frame module 180 may further include a dust collector 188 connected to the support frame 182.

According to various embodiments, the support frame module 180 may further include a control panel 196. The control panel 196 may be an electrical controller box including control buttons or switches for controlling the motor 152, the linear actuator 116 and the ancillary linear actuator 158. The support frame module 180 may further include a regulator panel 194. The regulator panel 194 may be a pneumatic control panel including air filters, pressure regulators and actuator solenoid control valves for controlling the ancillary linear actuator 158 when the ancillary linear actuator 158 is a pneumatic actuator.

According to various embodiments, there may be provided a method for grinding including mounting a workpiece to a holder, the holder may be connected to a linear actuator, the holder may be adapted to hold the workpiece with a surface of the workpiece facing a cylindrical surface of a cylinder, and operating the linear actuator to move the holder relative to the cylinder along a centreline of linear motion of the linear actuator. The cylinder may be mounted to a base with a longitudinal axis of the cylinder arranged at least substantially perpendicular to a surface of the base. The cylinder may be rotatable about the longitudinal axis of the cylinder. The cylindrical surface of the cylinder may be adapted to receive a grinding belt. The linear actuator may be mounted to the base with the centreline of linear motion of the linear actuator arranged to intersect the longitudinal axis of the cylinder. The cylindrical surface of the cylinder may be adapted to define a curved profile so that the grinding belt is adapted to grind and shape the surface of the workpiece to conform to the curved profile.

According to various embodiments, there may be provided a grinded workpiece grinded by the grinding module as described above, or by the grinding machine as described above, or by the method for grinding as described above.

Figure 2A:
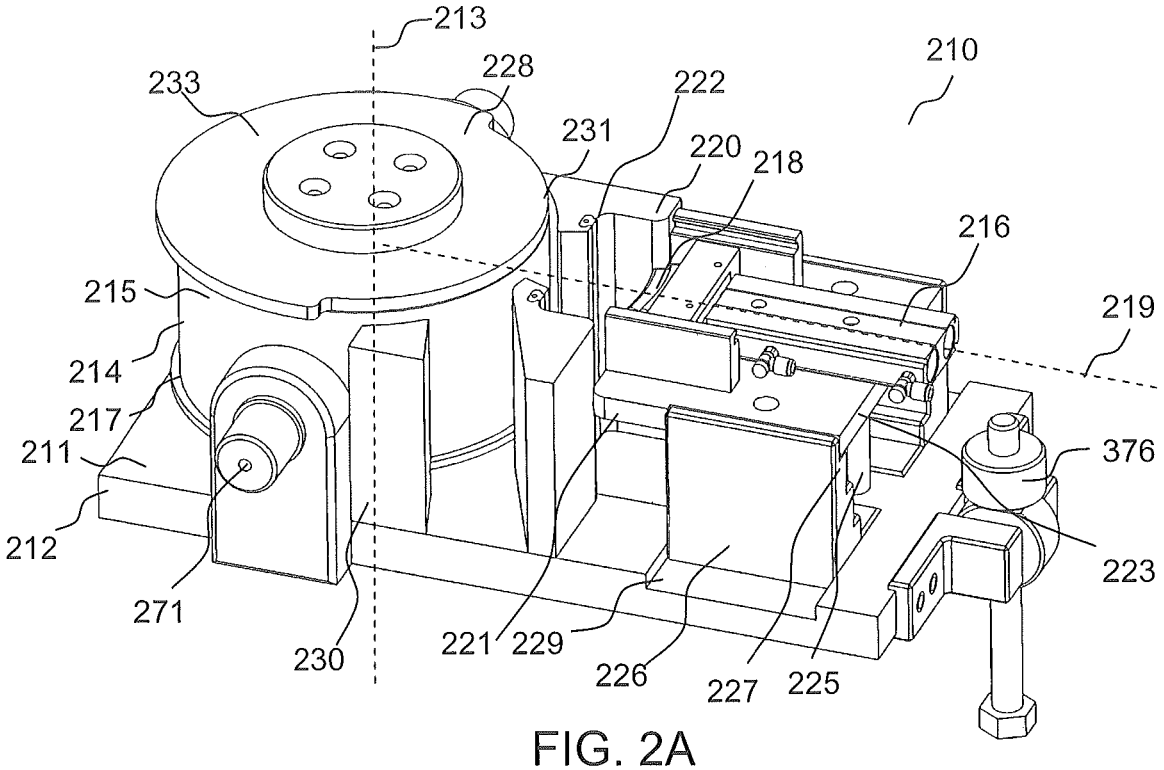
FIG. 2A shows a perspective view of a grinding module according to various embodiments.

FIG. 2A shows a perspective view of a grinding module 210 according to various embodiments. As shown, the grinding module 210 may include a base 212. The base 212 may be in the form of a plate as shown in FIG. 2A. The base 212 may also be in the form of a platform, a panel or other similar structure. The base 212 may function as a supporting structure which other components of the grinding module 210 may be mounted on.

The grinding module 210 may further include a cylinder 214 mounted to the base 212 with a longitudinal axis 213 of the cylinder 214 arranged at least substantially perpendicular to a surface 211 of the base 212. In other words, the cylinder 214 may be mounted to the base 212 such that an end circular surface of the cylinder 214 may be directly mounted on the surface 211 of the base 212. The cylinder 214 may be in the form of a drum or a barrel. The cylinder 214 may be made of metal. The cylinder 214 may be mounted to the base 212 such that the cylinder 214 may be rotatable about the longitudinal axis 213 of the cylinder 214. In an implementation, the cylinder 214 may include a through hole (not shown) extending along the longitudinal axis 213, and the base 212 may include an axle (not shown) protruding from the surface 211 of the base 212 such that the through hole of the cylinder 214 may be received on the axle of the base.

A cylindrical surface 215 of the cylinder 214 may be adapted to receive a grinding belt 336 (FIG. 3). The cylindrical surface 215 of the cylinder 214 may be adapted to directly receive the grinding belt 336. The cylinder 214 may include a rim 217 at the bottom of the cylinder 214 nearest to the surface 211 of the base 212. The rim 217 may protrude from the cylindrical surface 215 of the cylinder 214 such that the rim 217 may prevent the grinding belt 336 from slipping in the downward direction. Thus, the rim 217 may function as a guide for the grinding belt 336 received on the cylindrical surface 215 of the cylinder 214.

The grinding module 210 may further include a linear actuator 216 mounted to the base 212 with a centreline 219 of linear motion of the linear actuator 216 arranged to intersect the longitudinal axis 213 of the cylinder 214. As shown in FIG. 2A, the centerline 219 of linear motion of the linear actuator 216 may be arranged at least substantially perpendicular to the longitudinal axis 213 of the cylinder 214. The linear actuator 216 may be in the form of a mechanical actuator, electro-mechanical actuator, a hydraulic actuator, a pneumatic actuator or other actuating device that may generate a linear motion. In an implementation, the linear actuator 216 may be a dual shaft pneumatic actuator as shown in FIG. 2A. The grinding module 210 may include a support structure 221 connected to the base 212. The support structure 221 may be in the form of a T-shaped support structure 221 as shown in FIG. 2A, including a horizontal member 223 and a vertical member 225. The vertical member 225 of the support structure 221 may be connected to the base 212 such that the horizontal member 223 of the support structure 221 may be parallel to the surface 211 of the base 212. The linear actuator 216 may be attached to the horizontal member 223 of the support structure 221 such that the linear actuator 216 is mounted to the base 212. The linear actuator 216 may be attached such that the linear motion of the linear actuator 216 may be directed towards the cylindrical surface 215 of the cylinder 214.

Figure 2B:
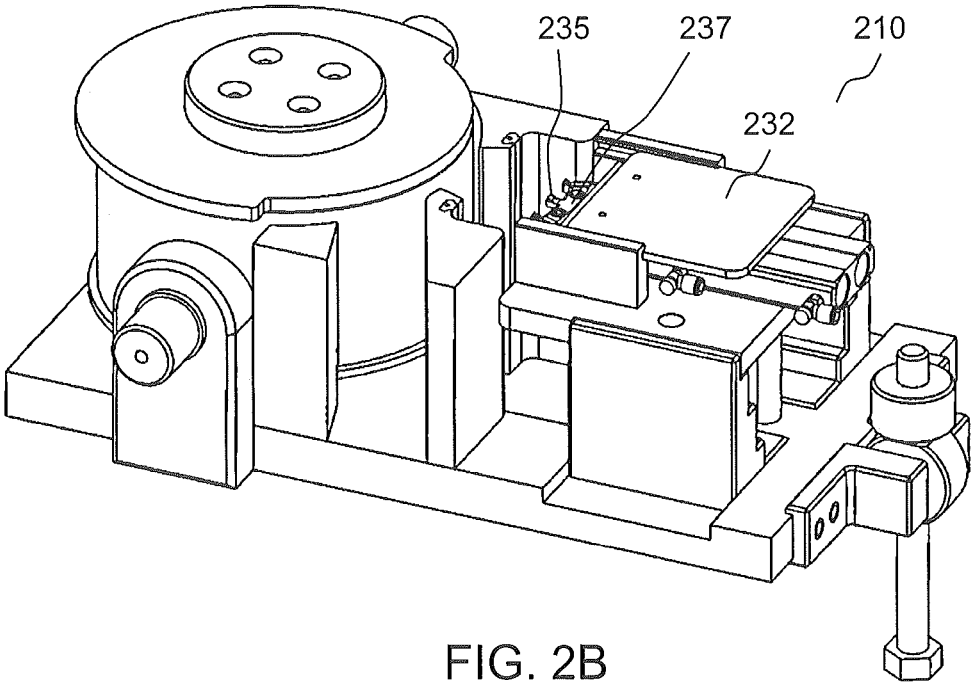
FIG. 2B shows a perspective view of the grinding module of FIG. 2A with a workpiece according to various embodiments.

The grinding module 210 may further include a holder 218 connected to the linear actuator 216. The holder 218 may be adapted to hold a workpiece 237 (FIG. 2B shows a perspective view of a grinding module 210 with the workpiece 237 according to various embodiments) with a surface 235 of the workpiece 237 facing the cylindrical surface 215 of the cylinder 214. The holder 218 may be in the form of a protrusion 234 which may receive a groove on the workpiece 237.

The holder 218 may be attached to an actuatable end of the linear actuator 216. The linear actuator 216 may be adapted to move the holder 218 relative to the cylinder 114 along the centreline 219 of linear motion of the linear actuator 216. The holder 218 may be moved towards the cylindrical surface 215 of the cylinder 214. When the grinding belt 336 is received on the cylindrical surface 215, the holder 218 may be moved such that the workpiece 237 held on the holder 218 may be moved toward the grinding belt 336. The surface 235 of the workpiece 237 may come into contact with the grinding belt 336 such that the grinding belt 336 may grind the surface 235 of the workpiece 237.

The cylindrical surface 215 of the cylinder 214 may be adapted to define a curved profile so that the grinding belt 336 may be adapted to grind and shape the surface of the workpiece to conform to the curved profile. The cylindrical surface 215 of the cylinder 214 may be a rigid, hard and solid surface such that the cylindrical surface 215 may provide a non-malleable contact surface to support the grinding belt 336 to grind and shape the surface 235 of the workpiece 237 into conformity with the curved profile of the cylindrical surface 215 of the cylinder 214. Accordingly, the shape and dimension of the grinded surface of the workpiece 237 may correspond with the curved profile of the cylindrical surface 215 of the cylinder 214. In other words, the shape and dimension of the grinded surface of the workpiece 237 may be controlled by the shape and curved profile of the cylindrical surface 215 of the cylinder 214. According to various embodiments, the cylinder 214 may be sized accordingly to accommodate the desired grinded surface of the workpiece 237. Cylinder 214 of different size and curved profile may be mounted to the base 212 to vary the dimension, shape and curved profile of the grinded surface of the workpiece 237.

As shown in FIG. 2B, the workpiece 237 may include a concave cylindrical surface 235. The surface of the workpiece 237 facing the cylindrical surface 215 of the cylinder 214 may be the concave cylindrical surface 235. The holder may be adapted to orientate the concave cylindrical surface 235 of the workpiece 237 so that a longitudinal axis of the concave cylindrical surface 235 is parallel to the longitudinal axis 213 of the cylinder 214, and the longitudinal axis of the concave cylindrical surface 235 intersects the centerline 219 of linear motion of the linear actuator 216. The holder may be adapted to hold the workpiece 237 such that when the linear actuator 216 moves the workpiece 237 towards the cylinder 214, the concave cylindrical surface 235 of the workpiece 237 may fit onto the cylindrical surface 215 of the cylinder 214, and the grinding belt 336 may be adapted to grind the concave cylindrical surface 235 to conform to the curved profile, i.e. shape and dimension, of the cylindrical surface 215 of the cylinder 214.

According to various embodiments, the grinding module 210 may further include a limiter 220 mounted to the base 212 and arranged between the cylinder 214 and the holder 218. The limiter 220 may be adapted to block the holder 218 at a predetermined distance from the cylindrical surface 215 of the cylinder 214. The limiter 220 may be in the form of a block attached on the base 212. The limiter 220 may function as a physical obstruction blocking the path of the holder 218 as the holder 218 is being moved towards the cylindrical surface 215 of the cylinder 214 by the linear actuator 216. A part of the holder 218 may come into contact with a portion of the limiter 220 which may prevent the holder 218 from further advancing towards the cylindrical surface 215 of the cylinder 214. The predetermined distance may be such that the workpiece 237 on the holder 218 may be grinded to the desired dimension.

Figure 2C:
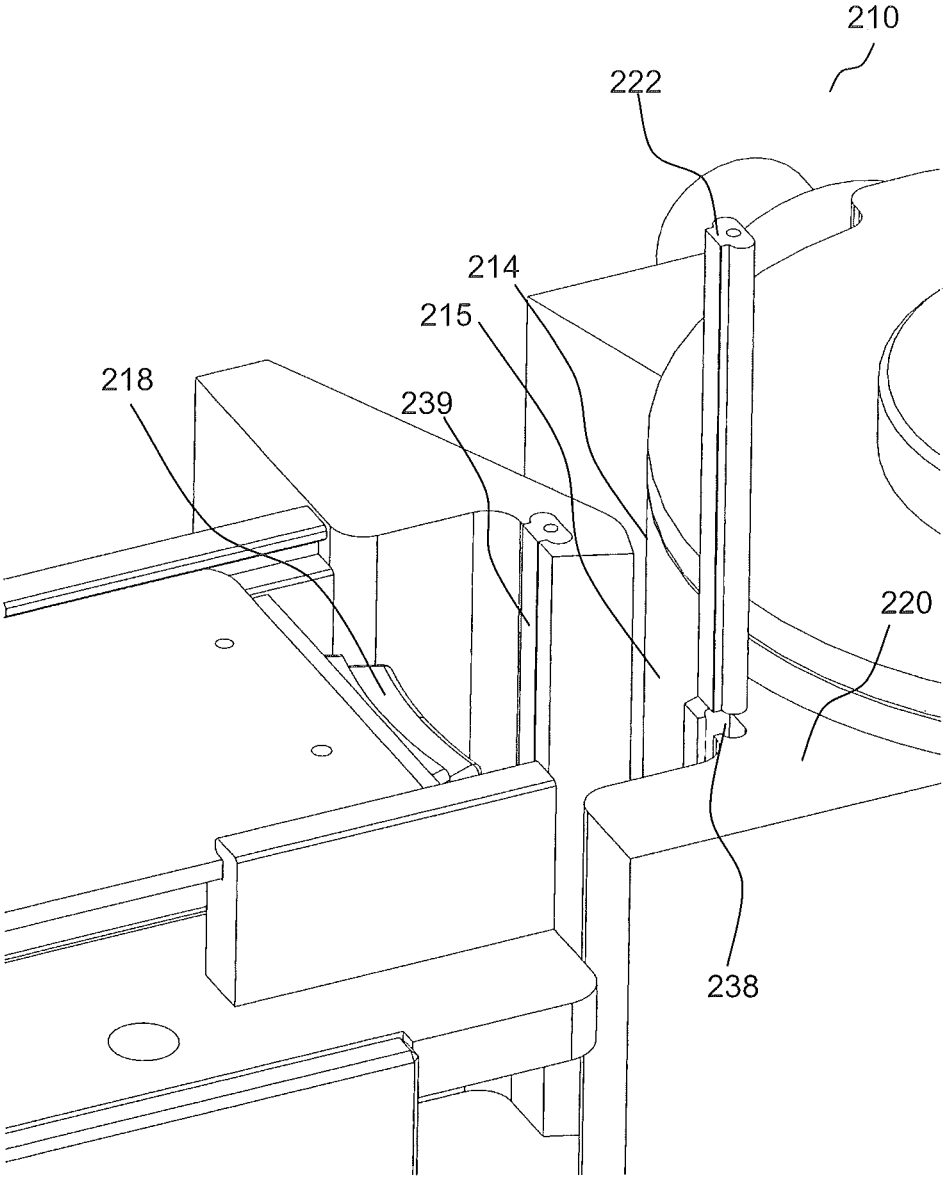
FIG. 2C shows a closed up view of a limiter of the grinding module of FIG. 2A according to various embodiments.

FIG. 2C shows a closed up view of the limiter 220 of the grinding module 210 according to various embodiments. According to various embodiments, the limiter 220 may include a limiter insert 222 removably receivable in the limiter 220. The limiter 220 may include a groove 238. The limiter insert 222 may be slidably received in the groove 238 of the limiter 220. The limiter insert 222 may also be slidably removed from the groove 238 of the limiter 220. When the limiter insert 222 is received in the groove 238 of the limiter 220, the limiter insert 222 may provide a protrusion 239 on a surface of the limiter 220, which faces the holder 218. The protrusion 239 from the surface of the limiter 220 may increase the predetermined distance from the cylindrical surface 215 of the cylinder 214 at which the limiter 220 blocks the holder 218. As the holder 218 moves towards the cylindrical surface 215 of the cylinder 214, the holder 218 may come into contact with the protrusion 239 which blocks the holder 218 from advancing further. Accordingly, the increased in the predetermined distance is equivalent to the length of the protrusion 239 measured from the surface of the limiter 220.

Advantageously, with the arrangement of the limiter insert 222 and the limiter 220, the grinding process may be divided into two grinding processes, a primary grinding process and a secondary grinding process. For the primary grinding process, the limiter insert 222 may be inserted into the limiter 220 such that the workpiece 237 may be grinded at the increased predetermined distance from the cylindrical surface 215 of the cylinder 214. This may allow the workpiece 237 to maintain a desired ungrinded excess portion. Subsequently, for the secondary grinding process, the limiter insert 222 may be removed to allow the workpiece 237 to be fully grinded at the predetermined distance from the cylindrical surface 215 of the cylinder 214 to obtain the final desired grinded workpiece 237. It may be advantageous to have two grinding processes. In the primary grinding process, the bulk of the excess material may be removed by grinding. In the secondary grinding process, finer grinding may be achieved to produce the desired fine finishes and dimensions. The secondary grinding may also remove the grinding burns from the workpiece 237, which may occur during the primary grinding process.

According to various embodiments, the grinding module 210 may further include a stepped block 226 connected to the base 212 as shown in FIG. 2A. The stepped block 226 may include at least three steps 227 as shown. The stepped block 226 may be configured to be slidable on the surface 211 of the base 212. The base 212 may include an elongated recess portion 229 which may receive and guide the stepped block 226 to slide on the surface 211 of the base 212. The stepped block 226 may further be adapted to receive the linear actuator 216 on each step 227 of the stepped block 226 to vary a height of the linear actuator 216 from the base 212. As shown in FIG. 2A, the horizontal member 223 of the T-shaped support structure 221, on which the linear actuator 216 is mounted on, may be received on the highest step 227 of the stepped block 216 from the base 212. The stepped block 226 may be slided along the elongated recess portion 229 in the base 212 such that the horizontal member 223 of the T-shaped support structure 221 may be received on a lower step 227 of the stepped block 226 to adjust the height of the linear actuator 216 from the base 212. As the height of the horizontal member 223 of the T-shaped support structure 211 from the base 212 is lowered, the vertical member 225 of the T-shaped support structure 211 may be pushed through a through hole in the base 212. By allowing the height of the linear actuator 216, together with the holder 218, to be adjustable, the zone of the grinding belt 336 which is utilized for grinding the workpiece 237 may be varied such that a better utilization of the grinding belt 336 may be achieved.

According to various embodiments, the grinding module 210 may further include an asymmetrical disc 228 connected to an end of the cylinder 214 opposite the base 212. The asymmetrical disc may include a first arc sector 231 which may flush with the cylindrical surface 215 of the cylinder 214. The asymmetrical disc may include a second arc sector 233 which may protrude from the cylindrical surface 215 of the cylinder 214. The asymmetrical disc 228 may be arranged such that the first arc sector 231 may face the holder 218 and the linear actuator 216. The first arc sector 231 which flushes with the cylindrical surface 215 of the cylinder 214 may facilitate easy installation and removal of the grinding belt 336.

According to various embodiments, the grinding module 210 may further include a spark arrester 230. The spark arrester 230 may be arranged adjacent to the cylindrical surface 215 of the cylinder 214 such that grinding waste/spark may be channeled by the spark arrester 230 into a dust collector 388 mounted on the support frame module 380.

Figure 2D:
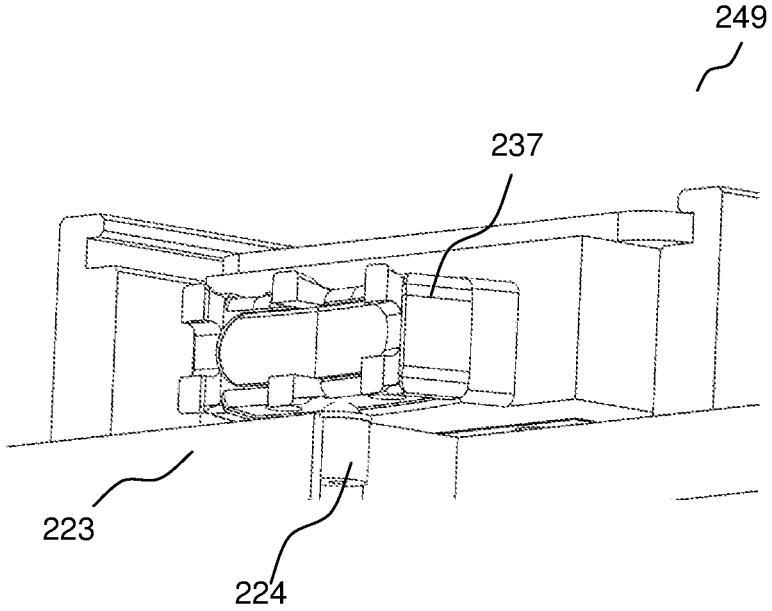
FIG. 2D shows a workpiece secured by a locking mechanism of the grinding module of FIG. 2A in the retracted position according to various embodiments.

According to various embodiments, the grinding module 210 may further include a locking mechanism 224 adapted to secure the workpiece 237 to the holder 218 in a retracted position relative to the linear actuator 216. FIG. 2D shows a closed up view 249 of the workpiece 237 secured by the locking mechanism 224 in the retracted position. As shown, the locking mechanism 224 may be in the form of a spring plunger. The spring plunger 224 may be connected to the horizontal member 223 of the T-shaped support structure 221. In the retracted position, the linear actuator 216 may be fully retracted such that the holder 218 may be at a farthest point measured from the cylindrical surface 215 of the cylinder 214. In this retracted position, the workpiece 237 may be loaded onto the protrusion 239 of the holder 218. The spring plunger 224 may subject a biasing pressure onto the underside of the workpiece 237 such that the workpiece 237 may be secured firmly onto the holder 218. Advantageously, with the workpiece 237 firmly secured to the holder 218, vibration of the grinding module 210 caused by running motor may not cause the workpiece 237 to fall off the holder 218 before the linear actuator 216 is operated to move the workpiece 237 towards the cylinder 214.

According to various embodiments, the grinding module 210 may further include a cover 232 over the linear actuator 216 as shown in FIG. 2B. As shown, the cover 232 may be placed over the linear actuator 216 to cover the movable components of the linear actuator 216. The cover 232 may function as a protective shield preventing external objects from coming close to movable components of the linear actuator 216. Thus, it may function as a safety cover to prevent a hand of an operator from being caught in movable components of the linear actuator 216.

Figure 3A:
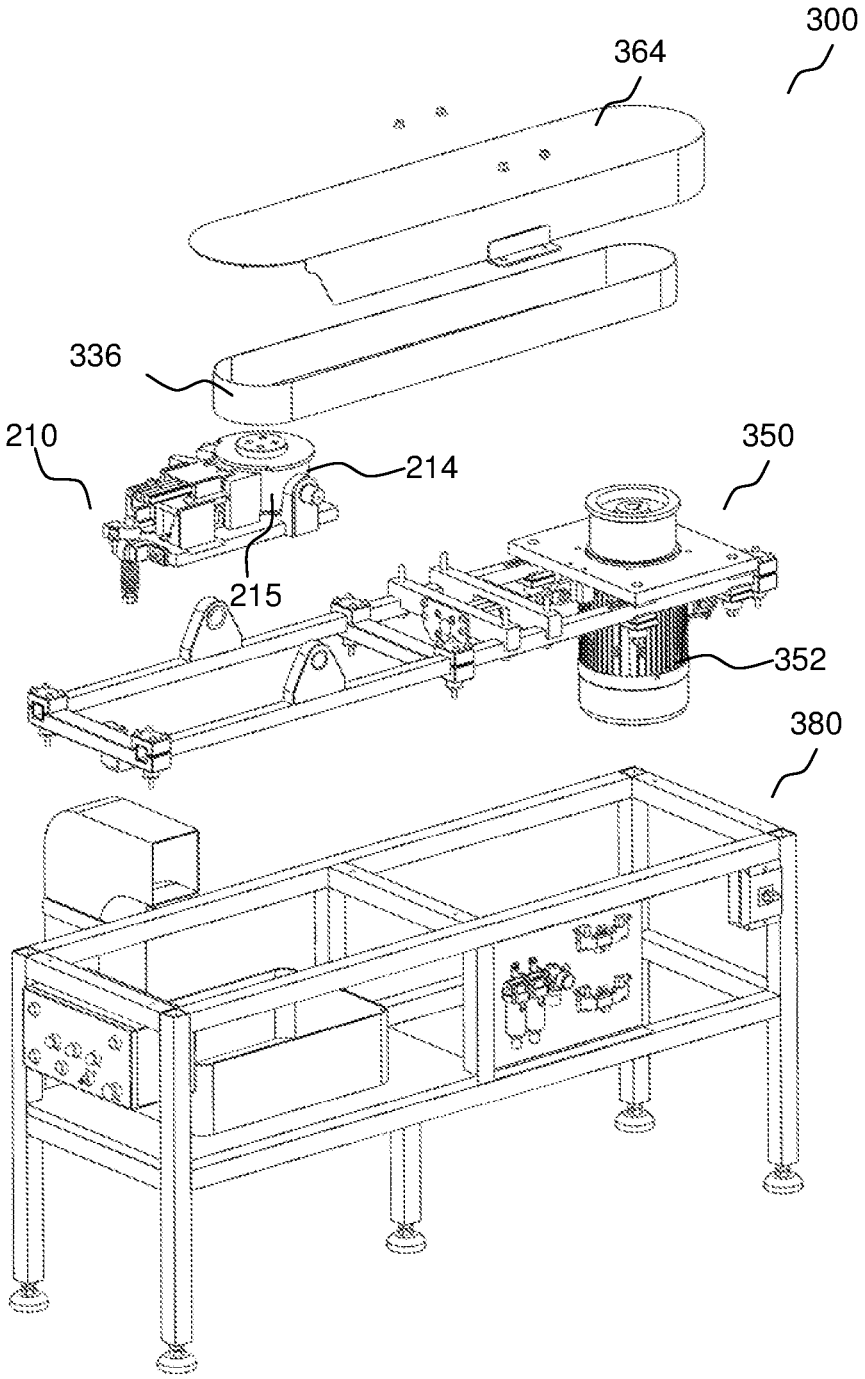
FIG. 3A shows an exploded view of a grinding machine according to various embodiments.
Figure 3B:
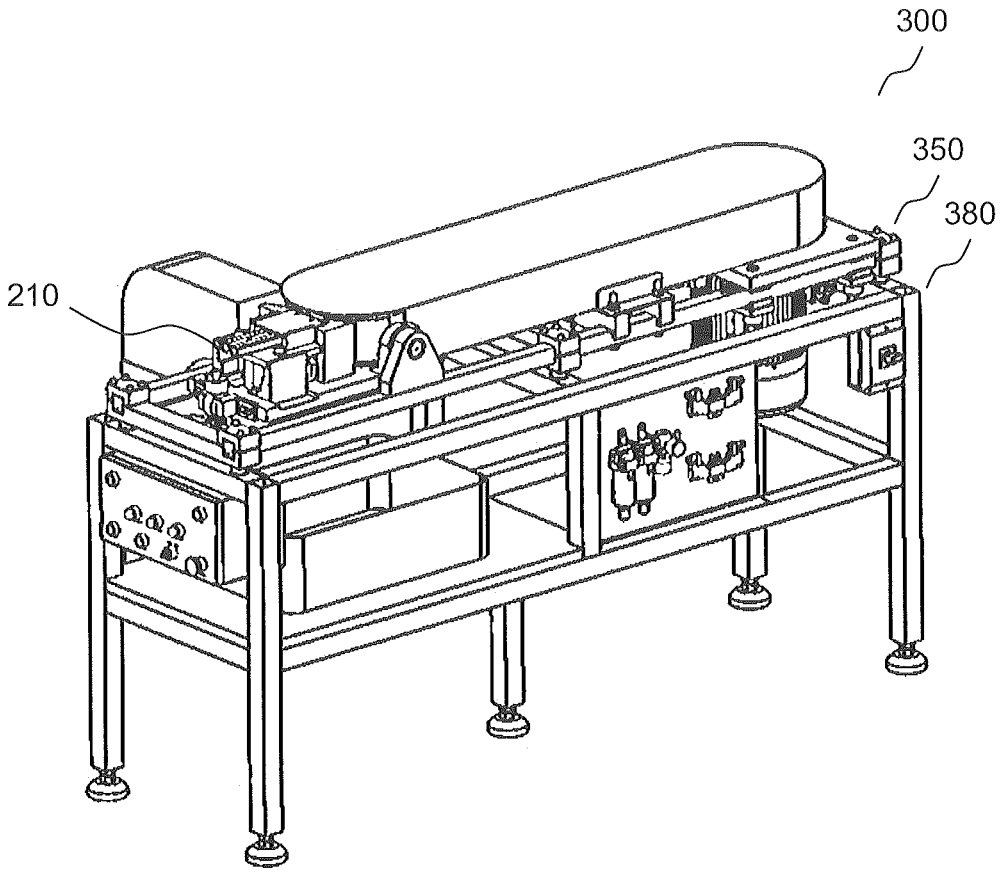
FIG. 3B shows an assembled view of the grinding machine of FIG. 3A according to various embodiments.

FIG. 3A shows an exploded view of a grinding machine 300. The grinding machine 300 may include a grinding module 210 as described above. The grinding machine 300 may further include a motor module 350 connected to the grinding module 210. The motor module 350 may include a motor 352 operable to drive the grinding belt 336 received on the cylindrical surface 215 of the cylinder 214 of the grinding module 210. The grinding machine 300 may further include a support frame module 380 connected to the motor module 350. The support frame module 380 may be adapted to support the motor module 350 and the grinding module 210. The grinding machine 300 may further include a safety cover 364 to provide cover for the grinding belt 336. FIG. 3B shows an assembled view of the grinding machine 300.

Figure 4A:
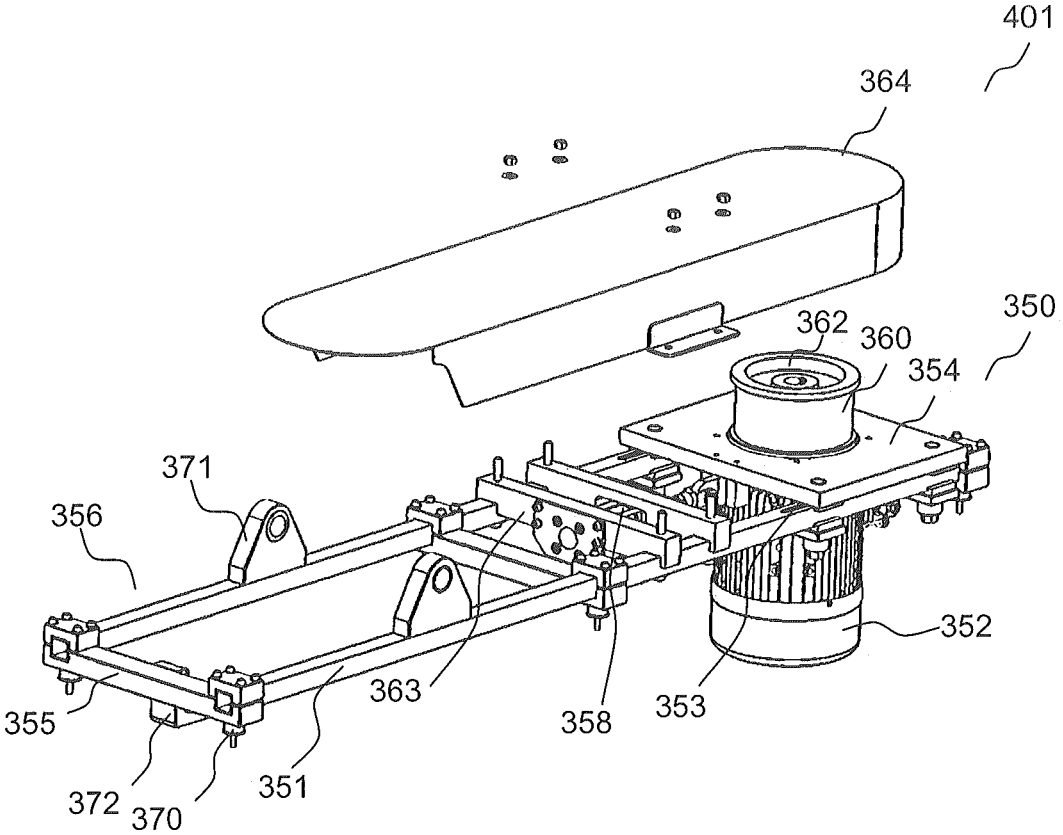
FIG. 4A shows a perspective view of a motor module of the grinding machine of FIG. 3A according to various embodiments.

FIG. 4A shows a perspective view 401 of the motor module 350 of the grinding machine 300. The motor module 350 may include a frame structure 356 and a mounting plate 354 slidably received on the frame structure 356. The motor 352 may be connected to the mounting plate 354. As shown, the frame structure 356 may include a pair of rails 351 with elongated slots 353 near an end of the pair of rails 351. The frame structure 356 may include rail spreaders 355 to maintain a distance between the pair of rails 351.

Figure 4B:
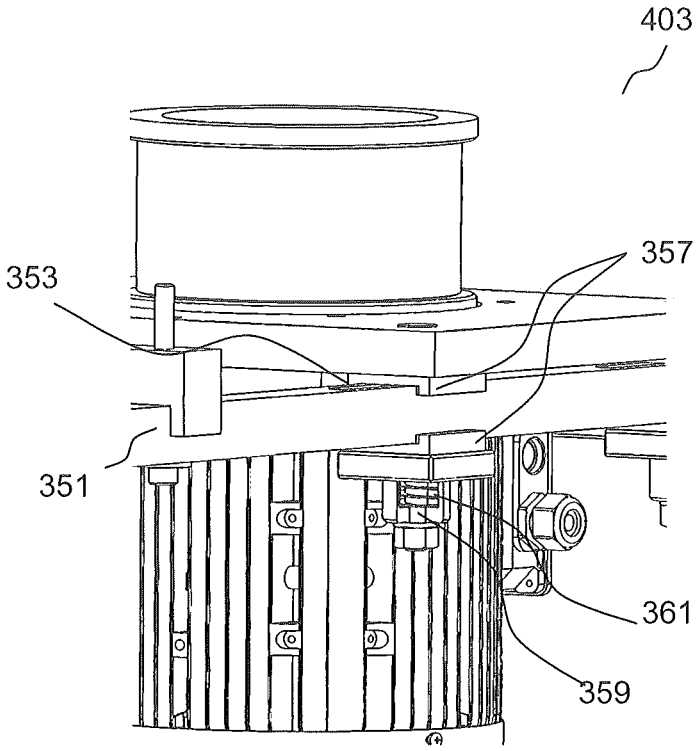
FIG. 4B shows a closed up view of the connection between a mounting plate and a rail of the motor module of FIG. 4A according to various embodiments.

FIG. 4B shows a closed up view 403 of the connection between the mounting plate 354 and the pair of rails 351 of the motor module 350 of the grinding machine 300. As shown, a pair of U-shaped blocks 357 sandwich the rail 351. The U-shaped blocks 357 may be made from Teflon material. A bolt 359 is shown to connect the bottom U-shaped block 357 through the slot 353 on the rail 351 to the upper U-shaped block 357. The upper U-shaped block 357 may be attached to a bottom surface of the mounting plate 354. A spring 361 is further shown to be disposed on the bolt 359 between a bolt head of the bolt 359 and the bottom U-shaped block 357. The spring 361 may provide a tensioning force for the bottom U-shaped block 357 to sandwich the rail 351 between the bottom U-shaped block 357 and the upper U-shaped block 359. This arrangement may be able to provide adequate force to secure the mounting plate 354 onto the rail 351 without generating excessive frictional force, thus allowing the mounting plate 354 to be slidable along the rail 351. The arrangement may facilitate effortless sliding movement of the mounting plate 354 with the motor 352 along the rail 351 for a predetermined distance defined by the length of the slot 353. The mounting plate 354 may be a square or rectangular plate. At each corner of the mounting plate 354, there may be one such connection arrangement to connect the mounting plate 354 to the pair of rails 351.

According to various embodiments, the motor module 350 may further include an ancillary linear actuator 358 connecting the mounting plate 354 to the frame structure 356. The ancillary linear actuator 358 may be adapted to move the mounting plate 354 relative to the frame structure 356. As shown in FIG. 4A, the frame structure 356 may include a pair of actuator mount 363. The pair of actuator mount 363 may be located substantially at the middle of the pair of rails 351. The ancillary linear actuator 358 may be mounted on the actuator mount 363 to connect with the frame structure 356. Further, the movable end of the ancillary linear actuator 358 may be connected to the mounting plate 354. In this arrangement, the extension and retraction of the ancillary linear actuator 358 may cause the mounting plate 358 to slide relative along the pair of rails 351 of the frame structure 356. Advantageously, the extension and retraction of the ancillary linear actuator 358 may facilitate easy changing of the grinding belt 336 or easy adjustment of the tension of the grinding belt 336. This is because the ancillary linear actuator 358 may slide the mounting plate 358 carrying the motor 352 towards the grinding module 210 to loosen the grinding belt 336 so as to facilitate the ease of removal of the grinding belt 336. The ancillary linear actuator 358 may also be extended to slide the mounting plate 358 away from the grinding module 210 to provide constant positive tension on the grinding belt 336 and prevent any possible slippage of the grinding belt 336. The ancillary linear actuator 358 may be a pneumatic actuator, a hydraulic actuator or other mechanical actuator.

According to various embodiments, the motor module 350 may further include a contact wheel 360 connected to the motor 352. The contact wheel 360 may be adapted to receive the grinding belt 336 and to drive the grinding belt 336. The contact wheel 360 may be connected to the motor shaft of the motor 352. When the grinding belt 336 is received on the contact wheel 360, the motor 352 may rotate the contact wheel 360 and the contact wheel 360 may then act as a driving mechanism to drive the grinding belt 336.

Figure 4C:
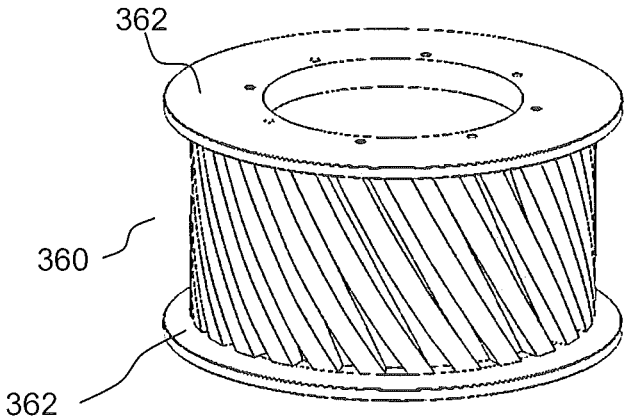
FIG. 4C shows a cross sectional view of a contact wheel of the motor module of FIG. 4A according to various embodiments.

According to various embodiments, the motor module 350 may further include a radial guide 362 connected to the contact wheel 360. The radial guide may be adapted to maintain the grinding belt 336 on the contact wheel 360. FIG. 4C shows a contact wheel 360 of the motor module 350 of the grinding machine 300. As shown, a pair of radial guide 362 may be connected to a top end and a bottom end respectively of the contact wheel 360. The radial guides 362 may function as a "track keeper" to keep the grinding belt 336 on the contact wheel 360. The contact wheel 360 may be any commercial-off-the-shelf contact wheel.

According to various embodiments, the motor module 350 may further include elastomer 370 located at the base of each individual rail spreader 355. The elastomer 370 may be adapted to isolate vibrational force caused by the motor 352 that may be transmitted onto the components of the support frame module 380.

Figure 5A:
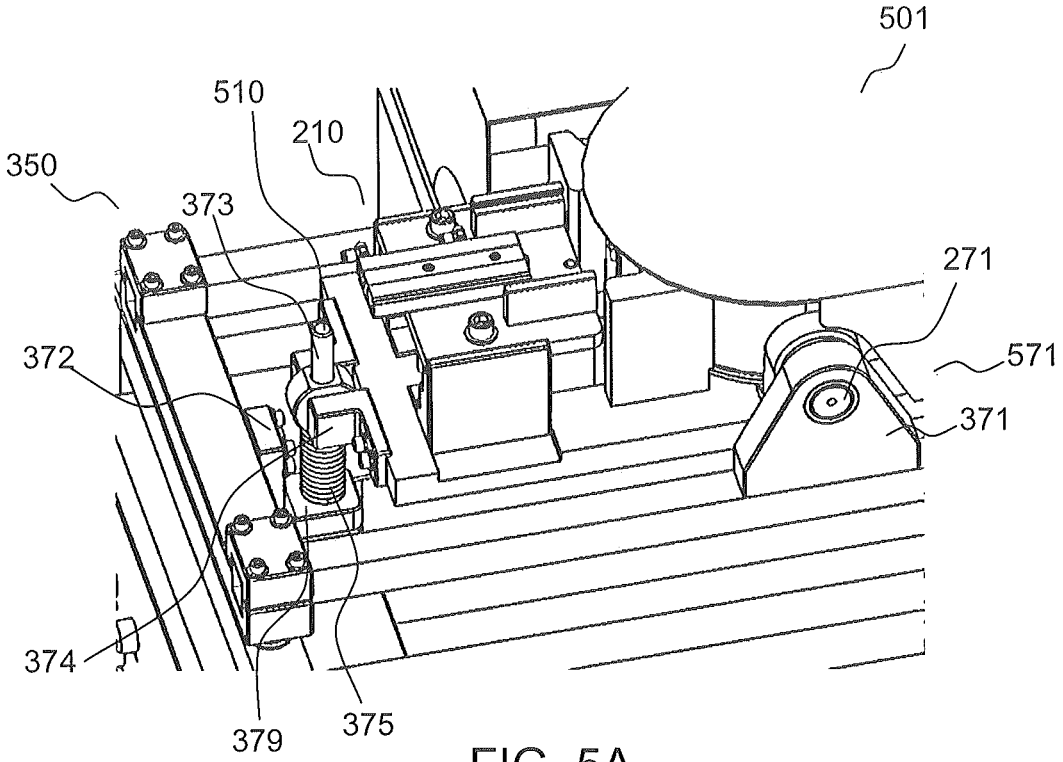
FIG. 5A shows a closed up view of a connection arrangement between the grinding module of FIG. 2A and the motor module of FIG. 4A according to various embodiments.
Figure 5B:
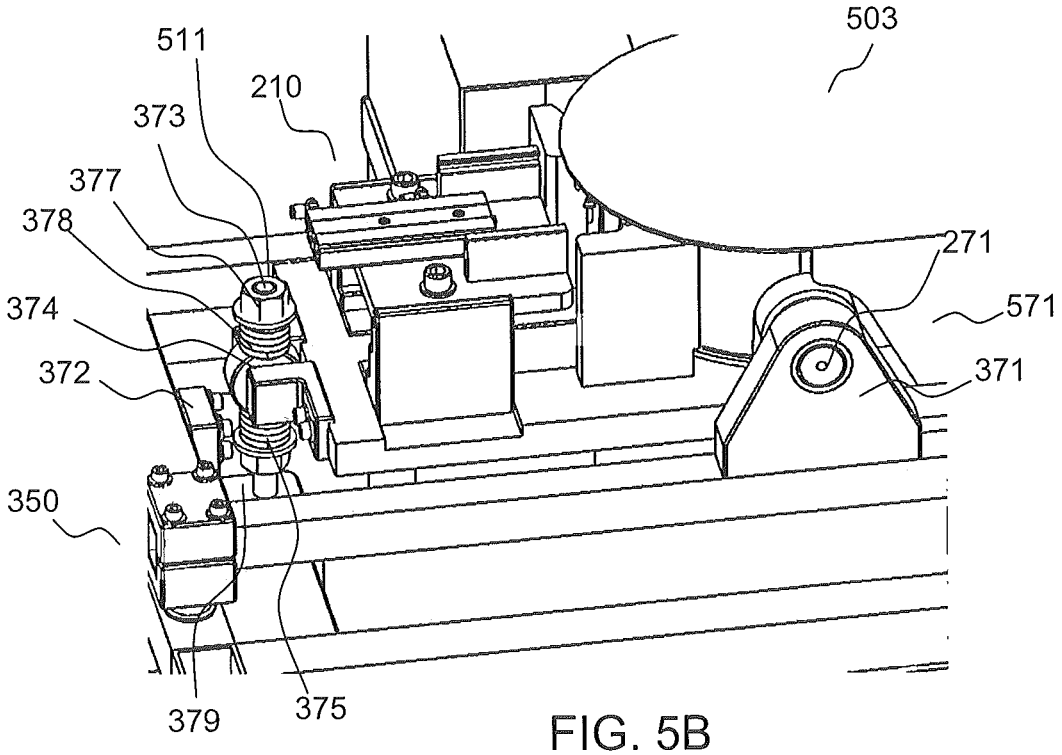
FIG. 5B shows a closed up view of a connection arrangement between the grinding module of FIG. 2A and the motor module of FIG. 4A according to various embodiments.

According to various embodiments, the grinding module 210 and the motor module 350 may be connected to each other via a pivot joint 571 (FIGS. 5A & 5B) and a leveling mechanism 510, 511 (FIGS. 5A & 5B). The motor module 350 may include a pivot bracket 371 as shown in FIG. 4A. The pivot bracket 371 may be located on the rail 351 of the frame structure 356. The pivot bracket 371 may be adapted to receive a pivot pin 271 of the grinding module 210 as shown in FIG. 2A. The pivot pin 271 of the grinding module 210 may be located on the base 212 of the grinding module 210.

FIG. 5A and FIG. 5B show closed up views of the connection arrangements 501 and 503 between the grinding module 210 and the motor module 350 according to various embodiments. The pivot pin 271 of the grinding module 210 is shown to be received in the pivot bracket 371 of the frame structure 356.

According to various embodiments, the workpiece 237 may be grind only on a segment across a width of the grinding belt 336 during the grinding process. The heat generated due to the grinding may cause an uneven expansion of the grinding belt 336 across the width of the grinding belt 336. The uneven expansion may cause the grinding belt 336 to slag and cause the grinding module 210 to be tilted about the pivot joint. The leveling mechanism 510, 511 connecting the motor module 350 to the grinding module 210 may allow compensation of the tilting of the grinding module 210 due to the slag of the grinding belt 336.

According to various embodiments, the motor module 350 may include a bracket (in other words a flange) 372 connected to the frame structure 356. The bracket 372 may be connected to the rail spreader 355 located at the end of the pair of rails 351 of the frame structure 356 opposite to the motor 352. The bracket 372 may be a L-shaped bracket with a first arm and a second arm adapted to substantially form a right angle. The L-shaped bracket 372 may be mounted to the rail spreader 355 such that the first arm of the L-shaped bracket 372 flushes against a surface of the rail spreader 355 and the second arm of the L-shaped bracket 372 projects away from the surface of the rail spreader 355. The second arm of the L-shaped bracket 372 may function as a "spring arrester" adapted to receive a spring load.

As shown in FIG. 5A, the leveling mechanism 510 of the connection arrangement 501 may include the bracket 372 connected to the frame structure 356 of the motor module 350. The leveling mechanism 510 may further include a bolt 373 with a first end of the bolt 373 connected to an arm 379 of the bracket 372. The bracket 372 may be connected to the frame structure 356 such that the arm 379 of the bracket 372 projects away from a surface of the frame structure 356 which the bracket 372 is connected to. The leveling mechanism 510 may further include a guide assembly 374 connected to the base 214 of the grinding module 210. The guide assembly 374 may be slidably received on the bolt 373. The leveling mechanism 510 may further include a spring 375 arranged on the bolt 373 between the arm 379 of the bracket 372 and the guide assembly 374. As shown in FIG. 2A, the leveling mechanism 510 may further include a knob 376 connected to a second end of the bolt 373. The leveling mechanism 510 in FIG. 5A may allow passive control of the leveling of the grinding module 210. An operator may adjust the knob 376 to manually tune the pitch angle of the grinding module 210. When the grinding module 210 becomes tilted due to the uneven expansion of the grinding belt 336, the operator may adjust the knob 376 to correct the pitch angle of the grinding module 210 to maintain the grinding belt 336 on the cylinder 214.

In FIG. 5B, the leveling mechanism 511 of the connection arrangement 503 may include the bracket 372 connected to the frame structure 356 of the motor module 350. The leveling mechanism 511 may further include a bolt 373 with a first end of the bolt connected to the arm 379 of the bracket 372. The bracket 372 may be connected to the frame structure 356 such that the arm 379 of the bracket 372 projects away from a surface of the frame structure 356 which the bracket 372 is connected to. The leveling mechanism 511 may further include a guide assembly 374 connected to the base 214 of the grinding module 210. The guide assembly 374 may be slidably received on the bolt 373. The leveling mechanism 511 may further include a nut 377 connected to a second end of the bolt 373. The leveling mechanism 511 may further include a first spring 375 arranged on the bolt 373 between the arm 379 of the bracket 372 and the guide assembly 374. The leveling mechanism 511 may further include a second spring 378 arranged on the bolt 373 between the guide assembly 374 and the nut 377. The leveling mechanism 511 in FIG. 5B may allow active control of the leveling of the grinding module 210. Tilting of the grinding module 210 caused by any form of uneven expansion in the grinding belt 336 may be counteracted by the pair of springs 375, 378 to correct the pitch angle of the grinding module 210 to maintain the grinding belt 336 on the cylinder 214.

According to various embodiments, the leveling mechanism 510, 511 may also advantageously absorb vibration created by the revolving cylinder 214.

Figure 6:
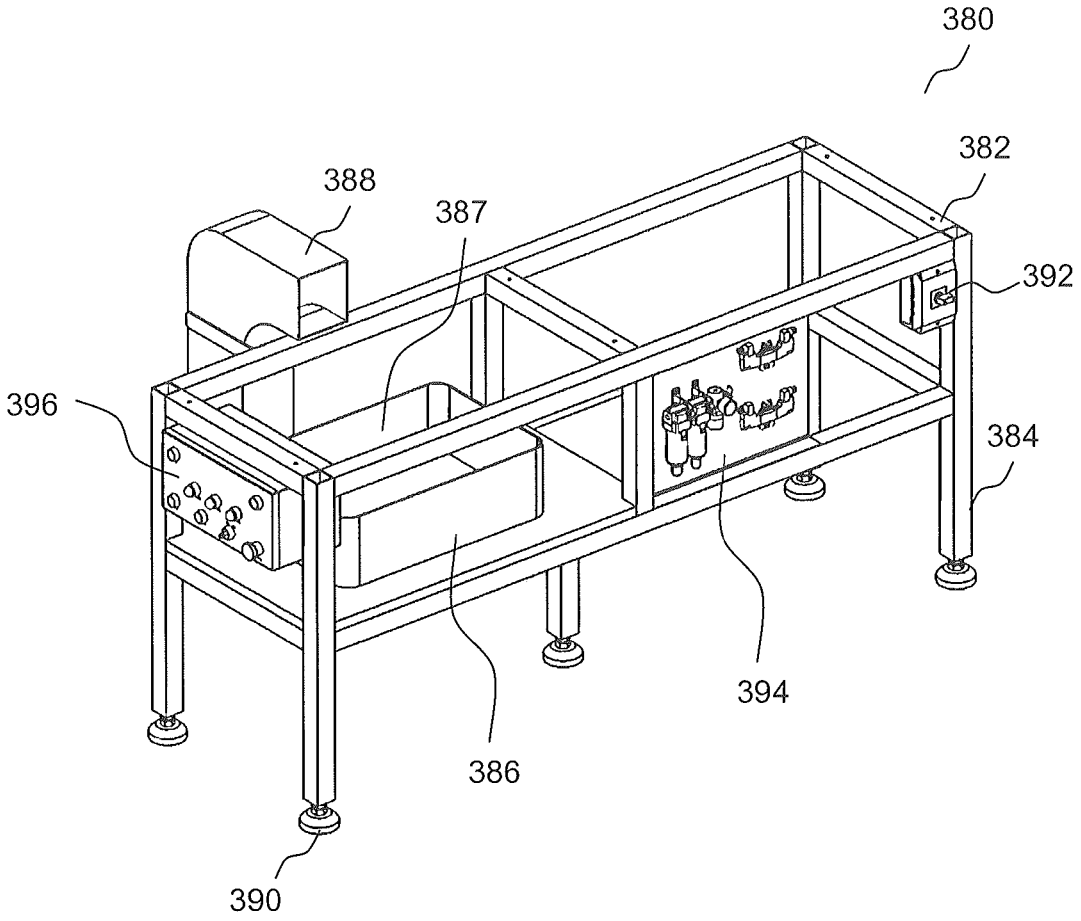
FIG. 6 shows a perspective view of a support frame module of the grinding machine of FIG. 3A according to various embodiments.

FIG. 6 shows a perspective view of the support frame module 380 of the grinding machine 300. As shown, the support frame module 380 may include a support frame 382. The support frame 382 may be adapted to receive the motor module 350. The support frame 382 may be a metal frame. The support frame module 380 may further include a support leg 384 connected to the support frame 382. As shown in FIG. 6, five support legs 384 may be connected to the support frame 382. The support frame module 380 may further include stabilizer 390 at the end of each leg 384. The stabilizer 390 may be utilized for leveling purposes to level the support frame 382.

The support frame module 380 may include a main power switch 392 attached to the support frame 382. The main power switch 392 may control the electrical supply going into the entire grinding machine 300. The support frame module 380 may further include a control panel 396 attached to the support frame 382. The control panel 396 may provide control buttons for controlling the motor 352, the linear actuator 216 that move the holder 218 relative to the cylinder 214, and the ancillary linear actuator 358 that move the mounting plate 354 relative to the frame structure 356. The control panel 396 may be located at the end of the support frame module 380 nearer to the grinding module 210 for easy access of the control buttons after the workpiece 237 if fitted on the holder 218 of the grinding module 210. The main power switch 392 may be located on the right side of the support frame 382.

According to various embodiments, a pair of buttons on the control panel 394 may be required to be activated simultaneously in order to operate the linear actuator 216 to extend so that the holder 218 may be moved towards the cylinder 214. The pair of buttons may act as a safety feature which may prevent accidental activation of the linear actuator 216. This is because a deliberate effort has to be made to activate both buttons simultaneously. During the extension stroke of the linear actuator 216, if any one of the pair of buttons is released, the linear actuator 216 may be retracted.

According to various embodiments, during the retraction stroke of the linear actuator 216, the workpiece 237 held by the holder 218 may disengage from the holder 218 and fall off from the holder 218. Initially, when the workpiece 237 is fitted onto the holder 218, the linear actuator 216 may be in the retracted position. As shown in FIG. 2D, the workpiece 237 may be secure firmly on the holder 218 by the locking mechanism 224, such as a spring plunger, which exerts a upward force on the underside of the workpiece 237 from the horizontal member 223 of the support structure 221. When the linear actuator 216 is activated to extend, the workpiece 237 may be pushed out of the locking mechanism 224, such that the workpiece 237 may be loosely held by the holder 218. As the linear actuator 216 is extending, the holder 218 will continue to push the workpiece 237 towards the cylinder 214 and thus the workpiece 237 may remain to be held by the holder 218 in view of the lateral pushing force from the holder 218 acting on the workpiece 237. When the linear actuator 216 is retracting, the holder 218 will be retracted together with the linear actuator 216. However, as the workpiece 237 is loosely held by the holder 218, the workpiece 237 may not be retracted together with the holder 218. The workpiece 237 may come off the holder 218 and disengage from the holder 218 as the holder 218 is retracting with the linear actuator 216.

Figure 2E:
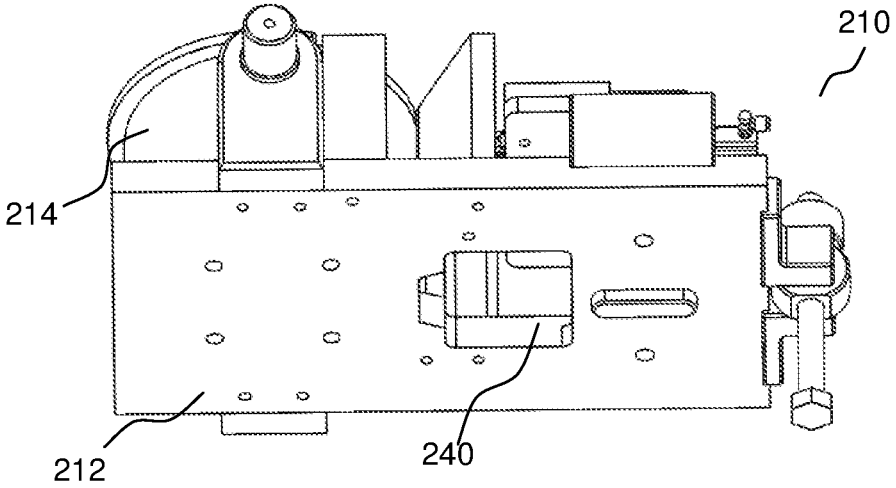
FIG. 2E shows a perspective view from the bottom of the grinding module of FIG. 2A according to various embodiments.

FIG. 2E shows a perspective view from the bottom of the grinding module 210. As shown, the base 212 of the grinding module 210 may include an opening 240. The opening 240 may function as a dispensing window through which the workpiece 237 disengaged from the holder 218 may fall through and be collected from below the base 212 of the grinding module 210.

According to various embodiments, the support frame module 380 may include a collector box 386 connected to the support frame 382. A cavity 387 defined by the collector box 386 may be arranged to face the opening 240 of the base 212 of the grinding module 210 so that workpiece 237 falling through the opening 240 may be collected in the cavity 387 of the collector box 386. Accordingly, the collector box 386 may be positioned directly below the grinding module 210 to receive the grinded workpiece 237 that drop off from the grinding module 210.

According to various embodiments, the support frame module 380 may include a dust collector 388 connected to the support frame 382. The dust collector 388 may be aligned with the spark arrester 230 of the grinding module 210 so that grinding waste/debris may be directed into the dust collector.

According to various embodiments, the support frame module 380 may further include a regulator panel 394 attached to the support frame 382. When the linear actuator 216 of the grinding module 210 and the ancillary linear actuator 358 of the motor module 350 are pneumatic actuator, the regulator panel 394 may include air filters, pressure regulators and actuator solenoid control valves. The regulator panel 394 may be configured to receive input signals from the control panel 396 to provide directional control to the linear actuator 216 of the grinding module 210 and the ancillary linear actuator 358 of the motor module 350 via the regulators and control valves. The regulator panel 394 may be located on the right side of the support frame 382.

Figure 7A:
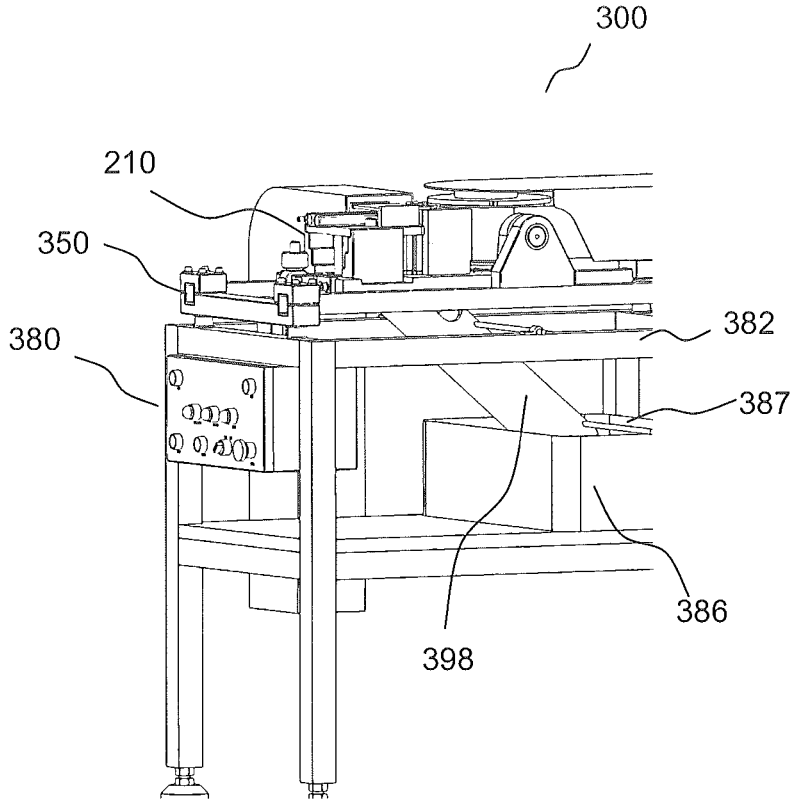
FIG. 7A shows a sliding track attached to a portion of the support frame of the grinding machine of FIG. 3A according to various embodiments.
Figure 7B:
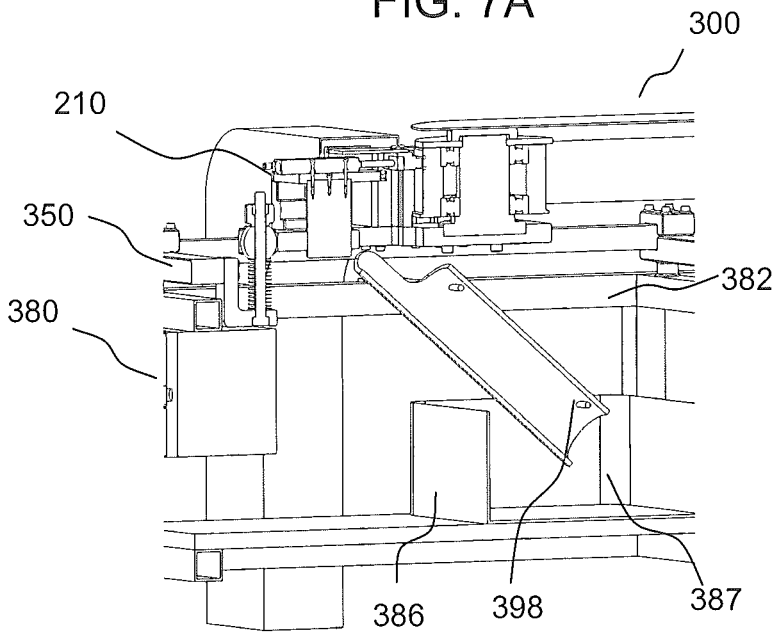
FIG. 7B shows a cross sectional view of the sliding track of FIG. 7A.

According to various embodiments, the support frame module 380 of the grinding machine 300 may include a sliding track 398. FIG. 7A shows a sliding track 398 attached to a portion of the support frame 382 of the grinding machine 300. FIG. 7B shows a cross sectional view of the sliding track 398. The sliding track 398 may be removably attached to the support frame 382 such that it may be optional to use the grinding machine 300 with the sliding track 398. The sliding track 398 may be arranged to incline at an angle such that an upper end of the sliding track 398 may be positioned beneath the opening 240 of the base 212 of the grinding module 210 and a lower end of the sliding track 398 may be positioned within the cavity 387 of the collector box 386. In this arrangement, the grinded workpiece 237 may dropped through the opening 240 of the base 212 of the grinding module 210 onto the upper end of the sliding track 398, and slide down the sliding track 398 toward the lower end into the cavity 387 of the collector box 386. Accordingly, this may prevent the grinded workpiece 237 from dropping directly into the collector box 386, thus preventing indentation on the grinded workpiece 237.

Figure 8:
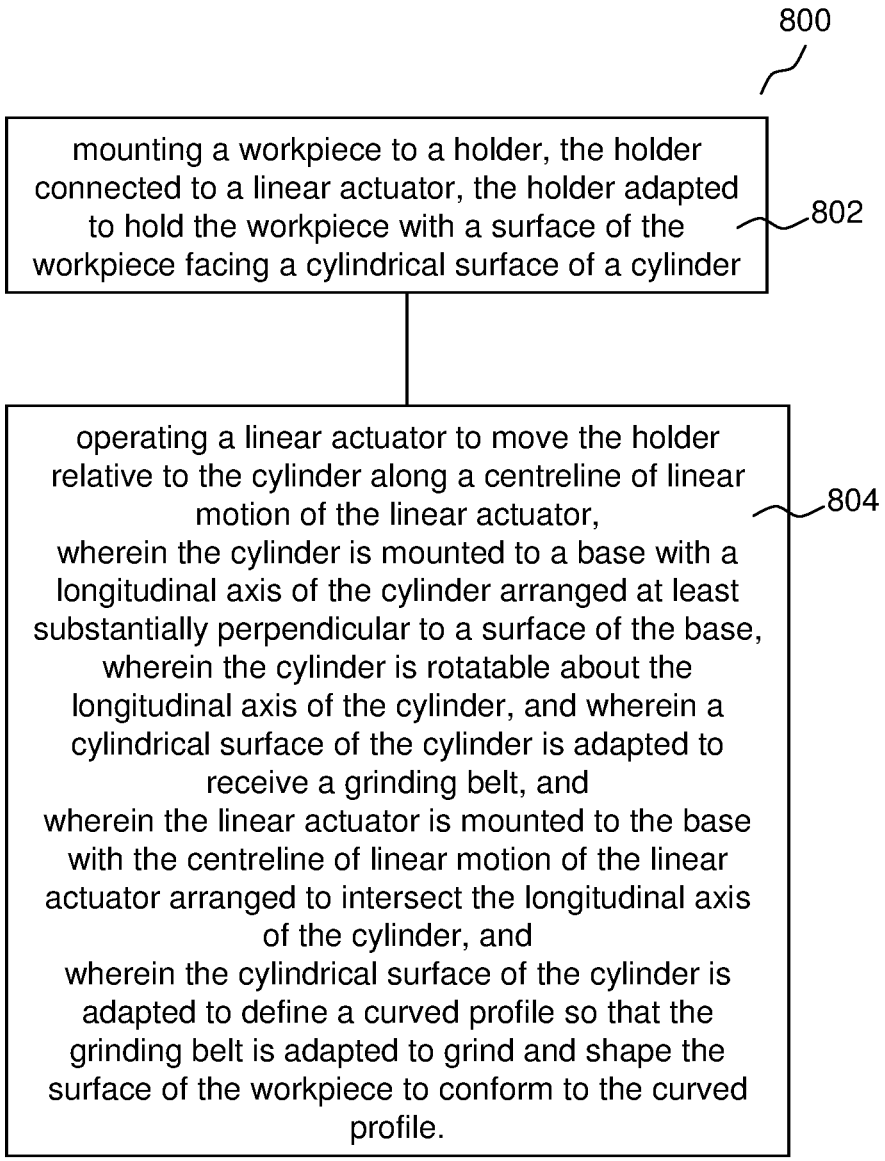
FIG. 8 shows a diagram of a method for grinding according to various embodiments.

FIG. 8 shows a diagram of a method for grinding 800 according to various embodiments. According to various embodiments, a method for grinding may be provided. The method for grinding may include mounting 802 a workpiece 237 to a holder 218, the holder 218 may be connected to a linear actuator 216, the holder 218 may be adapted to hold the workpiece 237 with a surface 235 of the workpiece 237 facing a cylindrical surface 215 of a cylinder 214, and operating 804 the linear actuator 216 to move the holder 218 relative to the cylinder 214 along a centreline 219 of linear motion of the linear actuator 216. The cylinder 214 may be mounted to a base 212 with a longitudinal axis 213 of the cylinder 214 arranged at least substantially perpendicular to a surface 211 of the base 212. The cylinder 214 may be rotatable about the longitudinal axis 213 of the cylinder 214. The cylindrical surface 215 of the cylinder 214 may be adapted to receive a grinding belt 336. The linear actuator 216 may be mounted to the base 212 with the centreline 219 of linear motion of the linear actuator 216 arranged to intersect the longitudinal axis 213 of the cylinder 214. The cylindrical surface 215 of the cylinder 214 may be adapted to define a curved profile so that the grinding belt 336 may be adapted to grind and shape the surface 235 of the workpiece 237 to conform to the curved profile.

The centreline 219 of linear motion of the linear actuator 216 may be arranged at least substantially perpendicular to the longitudinal axis 213 of the cylinder 214. The cylinder 214 may be made of metal. The cylindrical surface 215 of the cylinder 214 may be adapted to directly receive the grinding belt 336. The workpiece 237 may include a concave cylindrical surface. The surface 235 of the workpiece 237 facing the cylindrical surface 215 of the cylinder 214 may be the concave cylindrical surface. The holder 218 may be adapted to orientate the concave cylindrical surface 235 of the workpiece 237 so that a longitudinal axis of the concave cylindrical surface 235 is parallel to the longitudinal axis 213 of the cylinder 214 and the longitudinal axis of the concave cylindrical surface intersects the centreline 219 of linear motion of the linear actuator 216.

According to various embodiments, there may be provided a grinded workpiece 237 grinded by the grinding module 210 as described herein. According to various embodiments, there may be provided a grinded workpiece 237 grinded by the grinding machine 300 as described herein. According to various embodiments, there may be provided a grinded workpiece 237 grinded by the method for grinding as described herein.

Embodiments of the grinding module 210, the grinding machine 300 and the method for grinding may be used for grinding of components for an aircraft brake assembly manufactured from casting process. For example, the stator plate/channels, the rotor plate/channels, or the pressure plate/channels of the aircraft brake assembly manufactured using the investment casting process. The components may be casted into a casting tree including numerous such components. The individual components may be cut-off from the casting tree. However, the cut-off components may include gates that require post processing, such as grinding, to remove the excess material. Manual grinding to remove the gates is dependent on the skill of the operator. CNC milling/turning to remove the gates may involve higher cost and the time taken may not be faster than manual grinding.

Embodiments of the grinding module 210, the grinding machine 300 and the method for grinding may improve the time taken to grind the gates of the individual component. According to the various embodiments, the workpiece 237 may be grinded to the desired dimension with one single extension stroke of the linear actuator 216 of the grinding module 210. Based on testing conducted, the average time taken to grind a work piece to the desired dimension using the grinding module 210 is approximately 9 seconds per piece. In comparison, the average time taken for manual grinding or CNC milling/turning is approximately 2-3 minutes per piece.

Embodiments of the grinding module 210, the grinding machine 300 and the method for grinding may ensure consistency in the quality of the grinded component. This may be due to the final dimension of the grinded workpiece 237 is being controlled by the shape of the cylinder 214 of the grinding module 210. The cylinder 214 may be rigid and hard and the grinding belt 336 may be directly received on the cylinder 214. Accordingly, the workpiece 237 may be grinded to conform to the curve profile of the cylinder 214. Thus, the grinded workpiece 237 may be consistent in their dimension and shape.

Embodiments of the grinding module 210, the grinding machine 300 and the method for grinding may be less reliance on highly skilled operator. The grinding module 210 may be easy to operate because it only requires placing of the workpiece 237 on the holder 218 of the grinding module 210 and pressing of buttons to operate the linear actuator 216 of the grinding module 210. Thus, an untrained worker could easily execute the task of grinding the workpiece 237 in a safely manner. The various safety features of the grinding module 210 also ensures that the grinding of the workpiece 237 may be conducted in a manner that meet the safety standards.

Embodiments of the grinding module 210, the grinding machine 300 and the method for grinding may improve Environment, Health and Safety (EHS) for the grinding operation. The features of the grinding module 210 may remove an operator from potential risks that could be encountered in manual grinding. For example, in manual grinding, the operator may be required to work in close vicinity with the fast moving grinding belt exposing the operator to potential danger of being caught by the moving grinding belt. In contrast, embodiments of the grinding module 210, the grinding machine 300 and the method for grinding, the action of feeding the workpiece 237 is automated to facilitate safe feeding of workpiece 237 to the grinding belt 336, and additional safety features such as spark arrester 230, safety covers 232, 364 and dust collector 388 are incorporated. Further, features of the grinding machine 300 may also improve the air quality during grinding operation. For example, the dust collector 388 may remove the grinding debris and waste. The dust collector 388 may be arranged so that the propulsive force of the grinding debris may direct debris/waste into a bin through the dust collector 388. Thus, air quality control may be implemented in an effective and efficient method.

Embodiments of the grinding module 210, the grinding machine 300 and the method for grinding may also substantially reduce the operation cost of grinding the workpiece. For example, labour cost may be reduced as low skilled labour could be deployed to perform the grinding. Replacement of grinding belt 336 of the grinding machine 300 may also be cheaper than the replacement of the cutters for CNC milling/turning machines.

Further to the above, embodiments of the grinding module 210, the grinding machine 300 and the method for grinding may effectively control the feed distance of the workpiece 237 with respect to the moving grinding belt 336 without depending on the operator to maintain a constant feed distance. Further, embodiments may maximize the usage of the grinding belt 336 through the use of the stepped blocks of the grinding module 210. Embodiments may allow grinded workpiece 237 to be automatically removed from the holder 218 of the grinding module 210 and collect the grinded workpiece 237 in a collector box 386. Embodiments may also facilitate the ease of grinding belt 336 change by having the contact wheel 360 and the motor 352 connected to the mounting plate 354 which is slidably received on the rails 351 of the frame structure 356, wherein the ancillary linear actuator 358 is operable to slide the mounting plate 354 relative to the frame structure 356.

Embodiments may improve the efficiency of the power train because embodiments employ a direct drive system connecting the driving wheel (in other words the contact wheel) directly onto the motor shaft thus reducing the mechanical losses. Accordingly, maintenance cost of the drive system may be reduced as the number of components is minimized. The drive system may also have improved durability because several vibration forces are at a minimum level in such a direct drive system.

While the invention has been particularly shown and described with reference to specific embodiments, it should be understood by those skilled in the art that various changes in form and detail may be made therein without departing from the scope of the invention as defined by the appended claims. The scope of the invention is thus indicated by the appended claims and all changes which come within the meaning and range of equivalency of the claims are therefore intended to be embraced.

The invention claimed is:

1. A grinding module comprising:

a base;

a cylinder mounted to the base with a longitudinal axis of the cylinder arranged substantially perpendicular to a surface of the base, wherein the cylinder is rotatable about the longitudinal axis of the cylinder, and wherein a cylindrical surface of the cylinder receives a grinding belt;

a linear actuator mounted to the base with a centreline of linear motion of the linear actuator arranged to intersect the longitudinal axis of the cylinder; and a holder connected to the linear actuator, wherein the holder holds a workpiece with a surface of the workpiece facing the cylindrical surface of the cylinder, wherein the linear actuator moves the holder relative to the cylinder along the centreline of linear motion of the linear actuator, and wherein the cylindrical surface of the cylinder defines a curved profile so that the grinding belt grinds and shapes the surface of the workpiece to conform to the curved profile; and a limiter mounted to the base and arranged between the cylinder and the holder in the direction of the centreline of linear motion, the limiter blocks movement of the holder relative to the cylinder along the centreline of linear motion of the linear actuator during grinding of the workpiece by a surface of the limiter abutting the holder at a first predetermined distance from the cylindrical surface of the cylinder with the surface of the workpiece positioned between the cylindrical surface of the cylinder and the surface of the limiter in the direction of the centreline of linear motion.

2. The grinding module according to claim 1, wherein the centreline of linear motion of the linear actuator is arranged at least substantially perpendicular to the longitudinal axis of the cylinder.

3. The grinding module according to claim 1, wherein the cylinder is made of metal.

4. The grinding module according to claim 1, wherein the cylindrical surface of the cylinder is adapted to directly receive the grinding belt.

5. The grinding module according to claim 1, wherein the workpiece comprises a concave cylindrical surface, and wherein the surface of the workpiece facing the cylindrical surface of the cylinder is the concave cylindrical surface, and wherein the holder is adapted to orientate the concave cylindrical surface of the workpiece so that a longitudinal axis of the concave cylindrical surface is parallel to the longitudinal axis of the cylinder and the longitudinal axis of the concave cylindrical surface intersects the centreline of linear motion of the linear actuator.

6. The grinding module according to claim 1, wherein the limiter comprises a limiter insert removably receivable in the limiter, wherein the limiter insert received in the limiter is adapted to provide a protrusion on a surface of the limiter facing the holder to increase the predetermined distance at which the limiter blocks the holder.

7. The grinding module according claim 1, further comprising a locking mechanism adapted to secure the workpiece to the holder in a retracted position relative to the linear actuator.

8. The grinding module according to claim 1, further comprising a stepped block connected to the base, the stepped block adapted to receive the linear actuator on each step of the stepped block to vary a height of the linear actuator from the base.

9. The grinding module according to claim 1, further comprising an asymmetrical disc connected to an end of the cylinder opposite the base, wherein the asymmetrical disc comprises a first arc sector adapted to flush with the cylindrical surface of the cylinder and a second arc sector adapted to protrude from the cylindrical surface of the cylinder.

10. The grinding module according to claim 1 further comprising a spark arrester mounted on the base, the spark arrester arranged adjacent to the cylindrical surface of the cylinder.

11. The grinding module according to claim 1, further comprising a cover over the linear actuator.

12. A grinding machine comprising:

a grinding module according to claim 1;

a motor module connected to the grinding module, the motor module comprising a motor operable to drive the grinding belt received on the cylindrical surface of the cylinder of the grinding module; and a support frame module connected to the motor module, the support frame module adapted to support the motor module and the grinding module.

13. The grinding machine according to claim 12, wherein the motor module further comprises:

a frame structure; and a mounting plate slidably received on the frame structure, wherein the motor is connected to the mounting plate, and wherein the motor module further comprises an ancillary linear actuator connecting the mounting plate to the frame structure, wherein the ancillary linear actuator is adapted to move the mounting plate relative to the frame structure.

14. The grinding machine according to claim 12, wherein the motor module comprises a contact wheel connected to the motor, and wherein the contact wheel is adapted to receive the grinding belt and to drive the grinding belt, and wherein the motor module further comprises a radial guide connected to the contact wheel, the radial guide is adapted to maintain the grinding belt on the contact wheel.

15. The grinding machine according to claim 12, wherein the grinding module and the motor module are connected to each other via a pivot joint and a levelling mechanism, and wherein the levelling mechanism comprises:

a bracket connected to the frame structure of the motor module;

a bolt with a first end of the bolt connected to an arm of the bracket;

a guide assembly connected to the base of the grinding module, the guide assembly is slidably received on the bolt;

a spring arranged on the bolt between the arm of the bracket and the guide assembly; and a knob connected to a second end of the bolt, or wherein the levelling mechanism comprises:

a bracket connected to the frame structure of the motor module;

a bolt with a first end of the bolt connected to an arm of the bracket;

a guide assembly connected to the base of the grinding module, the guide assembly is slidably received on the bolt;

a nut connected to a second end of the bolt;

a first spring arranged on the bolt between the arm of the bracket and the guide assembly; and a second spring arranged on the bolt between the guide assembly and the nut.

16. The grinding machine according to claim 12, wherein the support frame module comprises:

a support frame; and a support leg connected to the support frame.

17. The grinding machine according to claim 12, wherein the base of the grinding module comprises an opening, and wherein the support frame module further comprise a collector box connected to the support frame, wherein a cavity defined by the collector box is arranged to face the opening of the base of the grinding module.

18. The grinding machine according claim 16, wherein the support frame module further comprises a dust collector connected to the support frame.

19. A method for grinding comprising:

mounting a workpiece to a holder, the holder connected to a linear actuator, wherein the holder holds the workpiece with a surface of the workpiece facing a cylindrical surface of a cylinder; and operating the linear actuator to move the holder relative to the cylinder along a centreline of linear motion of the linear actuator, wherein the cylinder is mounted to a base with a longitudinal axis of the cylinder arranged at least substantially perpendicular to a surface of the base, wherein the cylinder is rotatable about the longitudinal axis of the cylinder, and wherein a cylindrical surface of the cylinder receives a grinding belt, and wherein the linear actuator is mounted to the base with the centreline of linear motion of the linear actuator arranged to intersect the longitudinal axis of the cylinder, and wherein the cylindrical surface of the cylinder defines a curved profile so that the grinding belt grinds and shapes the surface of the workpiece to conform to the curved profile; and blocking movement of the holder relative to the cylinder along the centreline of linear motion of the linear actuator at a predetermined distance from the cylindrical surface of the cylinder, using a limiter mounted to the base and arranged between the cylinder and the holder in the direction of the centreline of linear motion, wherein the limiter blocks movement of the holder relative to the cylinder along the centreline of linear motion of the linear actuator during grinding of the workpiece by a surface of the limiter abutting the holder at a predetermined distance from the cylindrical surface of the cylinder with the surface of the workpiece positioned between the cylindrical surface of the cylinder and the surface of the limiter in the direction of the centreline of linear motion.

20. A grinding module comprising:

a base;

a cylinder mounted to the base with a longitudinal axis of the cylinder arranged substantially perpendicular to a surface of the base, wherein the cylinder is rotatable about the longitudinal axis of the cylinder, and wherein a cylindrical surface of the cylinder receives a grinding belt;

a linear actuator mounted to the base with a centreline of linear motion of the linear actuator arranged to intersect the longitudinal axis of the cylinder; and a holder connected to the linear actuator, wherein the holder holds a workpiece with a surface of the workpiece facing the cylindrical surface of the cylinder, wherein the linear actuator moves the holder relative to the cylinder along the centreline of linear motion of the linear actuator, and wherein the cylindrical surface of the cylinder defines a curved profile so that the grinding belt grinds and shapes the surface of the workpiece to conform to the curved profile; and a non-moveable limiter mounted to the base and arranged between the cylinder and the holder in the direction of the centreline of linear motion, the limiter blocks movement of the holder relative to the cylinder along the centreline of linear motion of the linear actuator during grinding of the workpiece by a surface of the limiter abutting the holder at a predetermined distance from the cylindrical surface of the cylinder with the surface of the workpiece positioned between the cylindrical surface of the cylinder and the surface of the limiter in the direction of the centreline of linear motion.

* * * * *